US012490809B2

(12) United States Patent
Weinberger et al.

(10) Patent No.: US 12,490,809 B2
(45) Date of Patent: Dec. 9, 2025

(54) MULTI-CHAMBER USER DEVICE

(71) Applicant: GD Stride LTD, D.N. Arvot Hayarden (IL)

(72) Inventors: Gidon Michael Weinberger, D.N Arvot Hayarden (IL); Bruno J. Melki, Efrat (IL)

(73) Assignee: GD Stride LTD, D.N. Arvot Hayarden (IL)

( * ) Notice: Subject to any disclaimer, the term of this patent is extended or adjusted under 35 U.S.C. 154(b) by 0 days.

(21) Appl. No.: 18/816,358

(22) Filed: Aug. 27, 2024

(65) Prior Publication Data

US 2025/0072561 A1 Mar. 6, 2025

Related U.S. Application Data

(60) Provisional application No. 63/535,372, filed on Aug. 30, 2023.

(51) Int. Cl.

| | |
|---|---|
| ***A43B 17/03*** | (2006.01) |
| ***A43B 13/20*** | (2006.01) |
| ***A43B 23/02*** | (2006.01) |

(52) U.S. Cl.

CPC ..... *A43B 17/035* (2013.01); *A43B 13/20* (2013.01); *A43B 23/029* (2013.01)

(58) Field of Classification Search

CPC ..... A43B 17/035; A43B 17/03; A43B 13/20; A43B 13/203; A43B 23/029

USPC ..... 36/29

See application file for complete search history.

(56) References Cited

U.S. PATENT DOCUMENTS

| | | | | |
|---|---|---|---|---|
| 4,730,403 A * | 3/1988 | Walkhoff | ..... | A43B 5/0407 36/117.7 |
| 5,295,314 A * | 3/1994 | Moumdjian | ..... | A43B 13/203 36/76 R |
| 5,335,430 A * | 8/1994 | Fiso | ..... | A43B 23/029 36/88 |
| 6,305,102 B1 * | 10/2001 | Doyle | ..... | A43B 13/206 36/71 |

(Continued)

FOREIGN PATENT DOCUMENTS

| | | |
|---|---|---|
| KR | 20070090474 | 9/2007 |
| TW | 202008908 | 3/2020 |

OTHER PUBLICATIONS

An International Search Report and a Written Opinion both dated Dec. 3, 2024, which issued during the prosecution of Applicants PCT/IL2024/050858.

(Continued)

*Primary Examiner* — Marie D Bays

(74) *Attorney, Agent, or Firm* — Sughrue Mion, PLLC

(57) ABSTRACT

A user device (100) is provided. The user device is a footwear device (100*a*), a medical device (100*b*), a mattress device (100*c*), or a seat cushion (100*d*), and is shaped to define a plurality of chambers (28). Apparatus for use with the user device includes circuitry (34, 152) and a pump (38, 130). The circuitry includes at least one device pressure sensor (36) that measures pressure in the chambers. The pump is couplable to the user device by a user 18, and the circuitry actuates the pump to selectively inflate or deflate the plurality of chambers to at least two different respective pressures. The pump is decouplable from the user device without the decoupling affecting the respective pressures in the chambers. Other applications are also described.

7 Claims, 29 Drawing Sheets

(56) References Cited

U.S. PATENT DOCUMENTS

| | | | | |
|---|---|---|---|---|
| 2001/0018564 | A1 | 8/2001 | Manor et al. | |
| 2008/0097263 | A1 | 4/2008 | Grigoriev et al. | |
| 2009/0307926 | A1* | 12/2009 | O'Brien | A43B 13/125 36/35 B |
| 2011/0061148 | A1 | 3/2011 | Egozi | |
| 2011/0067264 | A1* | 3/2011 | Doyle | A43B 13/206 36/29 |
| 2011/0131839 | A1 | 6/2011 | Ballin et al. | |
| 2012/0073161 | A1* | 3/2012 | Doyle | A43B 13/203 36/29 |
| 2014/0165427 | A1* | 6/2014 | Molyneux | A43B 3/34 36/102 |
| 2015/0305436 | A1* | 10/2015 | Doyle | A43B 17/035 36/43 |
| 2018/0177449 | A1* | 6/2018 | Latey | A43B 3/34 |
| 2019/0159546 | A1* | 5/2019 | Cohen | A43B 3/35 |
| 2019/0358115 | A1 | 11/2019 | Waldridge | |
| 2019/0373984 | A1* | 12/2019 | Wijesundara | A43B 13/206 |
| 2020/0170343 | A1* | 6/2020 | Bailly | A43B 7/1455 |
| 2020/0375310 | A1* | 12/2020 | Weast | A43B 7/1425 |
| 2021/0113402 | A1 | 4/2021 | Wijesundara et al. | |
| 2021/0244128 | A1* | 8/2021 | Costa | A43B 3/0036 |
| 2021/0361031 | A1* | 11/2021 | Mou | A43B 3/26 |
| 2022/0110820 | A1 | 4/2022 | Tsai | |
| 2023/0055680 | A1* | 2/2023 | Casali | A43B 13/184 |

OTHER PUBLICATIONS

U.S. Appl. No. 63/535,372, filed Aug. 30, 2023.

* cited by examiner

MULTI-CHAMBER USER DEVICE

CROSS REFERENCE TO RELATED APPLICATION

The present application claims the priority of U.S. 63/535,372 to Weinberger et al., filed Aug. 30, 2023, entitled, "Inflatable insole," which is incorporated herein by reference.

This application is related to a PCT application entitled "Multi-chamber user device," filed on even date herewith.

FIELD OF INVENTION

Some applications of the present invention relate in general to controlling a user environment, e.g., enabling ease of walking. More specifically, some applications of the present invention relate to inflating chambers of a user device, e.g., a user's shoe insole to enable ease of walking.

BACKGROUND

A range of health conditions, including orthopedic ailments, arthritis, vascular disorders, and diabetes, may cause pain in a patient's foot, joints, and back. Foot lesions can also occur. This in turn may inhibit a patient's ability to walk. Insoles which fit into a user's shoe have been described as reducing the pressure applied to the affected area, and thereby enabling ease of walking.

TW202008908A describes an adaptive insole system. The patent describes that, when a mobile terminal executes an application in a detection mode, the mobile terminal determines a user's foot shape based on an archive database and a plurality of pressure signals from a smart insole and then displays a foot shape message for providing the user with an assessment report of his foot type. In addition, when the mobile terminal executes the application in a walking mode, a control signal is outputted by the mobile terminal according to the archive database and the plurality of pressure signals from the smart insole, so that, as the patent describes, at least one inflatable area of the smart insole is inflated or deflated for allowing the user's feet to be properly assisted and protected during walking through a physical mechanics principle.

US 2019/373984 to Wijesundara describes a dual-layer insole apparatus for diabetic foot lesion prevention and related methods. Some insole apparatuses have a body defining a plurality of cavities configured to be coupled to a fluid source such that, as the patent describes, the fluid source can deliver fluid to vary internal pressures of the cavities, and the body defines an insole-shaped structure.

KR20070090474A describes an air foot scan and orthotic insole to solve the problem of uneven pressure of a foot by examining pressure distribution of a foot and changing the air pressure according to such pressure distribution. An air foot scan and orthotic insole uses a foot correcting insole as a sensor to measure pressure of a foot portion and corrects pressure of a foot based on the measured pressure of the foot, and includes a foot correction insole, a connector, a connection tube, a connection portion, a body, a mechanical portion, an operation portion, and a display portion. In the foot correction insole, plural air bags are formed. The insole is inserted into a shoe and then is placed on the body. The mechanical portion includes a pressurizing pump and a pressure sensor for measuring/correcting pressure of plural air bags.

SUMMARY OF INVENTION

In accordance with an application of the present invention, a user device that is a footwear device (e.g., an insole apparatus), a medical device, a mattress device, or a seat cushion is provided. The user device is shaped to define a plurality of chambers which can be selectively inflated or deflated in accordance with the user's needs. For example, the insole apparatus may include an insole body defining a plurality of chambers, and be shaped and sized to be placed in a shoe of a user. The plurality of chambers of the insole apparatus can be selectively inflated in accordance with the user's needs in order to enable ease of walking.

It is noted that many features of the present application are described herein with respect to an insole body as an example of the user device. This is by way of example only and is not intended to be limiting. As further described hereinbelow, the user device may be any footwear device (e.g., an insole, a shoe, or a sock), a medical device (e.g., a bandage, cast, or wound packing apparatus), a mattress device (e.g., a mattress or a mattress cover), or a seat cushion (e.g., a chair cushion or bike seat).

In order to allow for the selective inflation of the plurality of chambers, the user device, e.g., insole apparatus, typically includes circuitry, including at least one pressure sensor that is configured to measure the pressure in the plurality of chambers. A pump is couplable to the user device to selectively inflate or deflate the plurality of chambers to at least two different respective pressures. For example, the pump is couplable to a user's shoe and to the insole body, and is therefore wearable by the user while walking, and also decouplable by the user from the shoe and insole body. The pump is decouplable by the user from the user device without the decoupling affecting the respective pressures in the plurality of chambers.

For some applications, a selector valve is provided in order to control which of the plurality of chambers is in fluid communication with the pump at any given time. This allows the chambers to be selectively inflated or deflated individually. As further described hereinbelow, for some applications, the selector valve may be part of a pumping apparatus that is external to the user device and couplable to the user device. Alternatively, for some applications, the selector valve may be built in to the user device and couplable to an external pump.

Additionally, methods of manufacturing are also provided for the user device. The methods of manufacturing describe the manufacturing of one integral piece of elastomer that is shaped to define the plurality of selectively inflatable or deflatable chambers.

There is therefore provided, in accordance with some applications of the present invention, apparatus for use with a user device selected from the group consisting of: a footwear device, a medical device, a mattress device, and a seat cushion, the user device shaped to define a plurality of chambers, the apparatus including:

circuitry, including at least one device pressure sensor that is configured to measure pressure in the plurality of chambers; and a pump that is:

(a) couplable to the user device by a user, the circuitry configured to actuate the pump when the pump is coupled to the user device to selectively inflate or deflate the plurality of chambers to at least two different respective pressures, and (b) decouplable by the user from the user device without the decoupling affecting the respective pressures in the plurality of chambers of the user device.

For some applications, the user device is the footwear device, the footwear device including an insole body defining the plurality of chambers and shaped and sized to be placed in a shoe of the user, and the pump is (a) couplable to the shoe and to the insole body by the user such that the pump is wearable by the user while the user walks, and (b) decouplable by the user from the shoe and from the insole body without the decoupling affecting the respective pressures in the plurality of chambers of the insole body.

For some applications a system is provided that includes the apparatus, the system further including the insole body. For example, the circuitry may be configured to actuate the pump when the pump is coupled to the insole body to selectively inflate the plurality of chambers to at least two different respective pressures.

For some application, the user device is the footwear device, the footwear device including a shoe, and the pump is (a) couplable to the shoe by the user such that the pump is wearable by the user while the user walks, and (b) decouplable by the user from the shoe without the decoupling affecting the respective pressures in the plurality of chambers.

For some applications, a system is provided that includes the apparatus, the system further including the shoe.

For some applications, the user device is the footwear device, the footwear device including a sock.

For some applications, a system is provided that includes the apparatus, the system further including the sock.

There is further provided, in accordance with some applications of the present invention, apparatus including a footwear device defining a plurality of chambers, such that in use a surface of the footwear device facing in an inferior direction faces a sole of a shoe; and a plurality of valves, each of the valves:

(a) in fluid communication with a respective one of the plurality of chambers, and (b) including an inlet to which a source of positive pressure is couplable to facilitate filling of the respective one of the plurality of chambers, the inlet facing in the inferior direction.

For some applications, the footwear device includes an insole body and is shaped and sized to be placed in the shoe.

For some applications, the footwear device includes an insole body that is an integral part of the shoe.

For some applications, the footwear device includes a sock.

There is further provided, in accordance with some applications of the present invention, apparatus for use with a user device selected from the group consisting of: a footwear device, a medical device, a mattress device, and a seat cushion, the user device shaped to define a plurality of chambers, the apparatus including:

a selector valve including a pump port and two or more additional ports, a first one of the additional ports coupled to a first one of the chambers and a second one of the additional ports coupled to a second one of the chambers;

a pump coupled to the pump port of the selector valve; and circuitry configured to actuate the pump to inflate or deflate the first and second chambers by activating the selector valve to provide fluid communication (a) between the first additional port and the pump, and, at a different time, (b) between the second additional port and the pump.

For some applications, the user device is the footwear device, the footwear device including an insole body defining the plurality of chambers and shaped and sized to be placed in a shoe of a user.

For some applications, a system is provided that includes the apparatus, the system further including the insole body. For example, the circuitry may be configured to actuate the pump to inflate the first and second chambers by activating the selector valve to provide fluid communication (a) between the first additional port and the pump, and, at a different time, (b) between the second additional port and the pump.

For some applications, the user device is the footwear device, the footwear device including a shoe.

For some applications, a system is provided that includes the apparatus, the system further including the shoe.

For some applications, the user device is the footwear device, the footwear device including a sock.

For some applications, a system is provided that includes the apparatus, the system further including the sock.

There is further provided, in accordance with some applications of the present invention, apparatus for use with a user device selected from the group consisting of: a footwear device, a medical device, a mattress device, and a seat cushion, the user device shaped to define a plurality of chambers, the apparatus including:

a selector valve including a pump port and two or more additional ports, a first one of the additional ports coupled to a first one of the chambers and a second one of the additional ports coupled to a second one of the chambers; and circuitry, including a pump pressure sensor that is coupled to the pump port of the selector valve, the circuitry configured to measure pressure in the first and second chambers by activating the selector valve to provide fluid communication (a) between the first additional port and the pump pressure sensor, and, at a different time, (b) between the second additional port and the pump pressure sensor.

For some applications, the user device is the footwear device, the footwear device including an insole body defining the plurality of chambers and shaped and sized to be placed in a shoe of a user.

For some applications, a system is provided that includes the apparatus, the system further including the insole body.

For some applications, the user device is a footwear device, the footwear device including a shoe.

For some applications, a system is provided that includes the apparatus, the system further including the shoe.

For some applications, the user device is the footwear device, the footwear device including a sock.

For some applications, a system is provided that includes the apparatus, the system further including the sock.

There is further provided, in accordance with some applications of the present invention, apparatus for use with a user device selected from the group consisting of: a footwear device, a medical device, a mattress device, and a seat cushion, the user device shaped to define a plurality of chambers, the apparatus including:

circuitry, including a device pressure sensor that is configured to measure pressure in the plurality of chambers; and a pump:

(a) couplable to the user device by a user, the pump configured when coupled to the user device to selec tively inflate or deflate the plurality of chambers to at least two different respective pressures, (b) decouplable by the user from the user device without the decoupling affecting the respective pressures in the plurality of chambers of the user device, and (c) including a pump pressure sensor, wherein the circuitry is configured to actuate the device pressure sensor to measure the pressure in the plurality of chambers at least when the pump is not coupled to the user device, and wherein the pump is configured to use pressure measurements from the pump pressure sensor during inflation or deflation of the plurality of chambers to regulate the inflation or deflation of the plurality of chambers.

For some applications:

the user device is the footwear device, the pump is couplable to a shoe and to the footwear device, the pump configured when coupled to the footwear device to selectively inflate or deflate the plurality of chambers to at least two different respective pressures, the pump is decouplable by the user from the shoe and from the footwear device without the decoupling affecting the respective pressures in the plurality of chambers of the footwear device, the circuitry is configured to actuate the device pressure sensor to measure the pressure in the plurality of chambers at least when the pump is not coupled to the footwear device, and the pump is configured to use pressure measurements from the pump pressure sensor during inflation or deflation of the plurality of chambers to regulate the inflation or deflation of the plurality of chambers.

For some applications, the footwear device is an insole body defining the plurality of chambers and shaped and sized to be placed in a shoe of a user.

For some applications, a system is provided that includes the apparatus, the system further including the insole body, wherein:

the pump is configured when coupled to the insole body to selectively inflate the plurality of chambers to at least two different respective pressures, the pump is decouplable by the user from the shoe and from the insole body without the decoupling deflating the plurality of chambers of the insole body, and the pump is configured to use pressure measurements from the pump pressure sensor during inflation of the plurality of chambers to regulate the inflation of the plurality of chambers.

For some applications, the footwear device includes a shoe.

For some applications, a system is provided that includes the apparatus, the system further including the shoe.

For some applications, the footwear device includes a sock.

For some applications, a system is provided that includes the apparatus, the system further including the sock.

There is further provided, in accordance with some applications of the present invention, apparatus including a user device selected from the group consisting of: a footwear device, a medical device, a mattress device, and a seat cushion, the user device:

defining a plurality of chambers; and including a resilient base on which the plurality of chambers are disposed, wherein in the absence of any forces applied to the resilient base a height of an upper surface of the resilient base under a first one of the chambers is higher than a height of the upper surface of the resilient base under a second one of the chambers.

For some applications, the user device is the footwear device, the footwear device including an insole body defining the plurality of chambers and shaped and sized to be placed in a shoe of a user.

For some applications, a system is provided that includes the apparatus, the system further including the insole body.

For some applications, the user device is the footwear device, the footwear device including a shoe.

For some applications, a system is provided that includes the apparatus, the system further including the shoe.

For some applications, the user device is the footwear device, the footwear device including a sock.

For some applications, a system is provided that includes the apparatus, the system further including the sock.

There is further provided, in accordance with some applications of the present invention, apparatus including:

a user device selected from the group consisting of: a footwear device, a medical device, a mattress device, and a chair cushion, the user device defining a plurality of chambers; and a plurality of tubes, each of the tubes:

(a) in fluid communication with a respective one of the plurality of chambers, and (b) including an inlet to which a source of positive pressure or negative pressure is couplable to selectively inflate or deflate the plurality of chambers to at least two different respective pressures, the user device including a lock arranged such that:

(a) when the lock is in an open position there is fluid communication between the inlet of each tube and the respective one of the plurality of chambers, and (b) when the lock is in a closed position, the lock occludes the plurality of tubes such that there is no fluid communication between the inlet of each tube and the respective one of the plurality of chambers.

For some applications, the user device is the footwear device, the footwear device including an insole body defining the plurality of chambers and shaped and sized to be placed in a shoe of a user.

For some applications, the user device is the footwear device, the footwear device including a shoe.

For some applications, the user device is the footwear device, the footwear device including a sock.

There is further provided, in accordance with some applications of the present invention, apparatus including:

a user device selected from the group consisting of: a footwear device, a medical device, a mattress device, and a seat cushion, the user device defining a plurality of chambers, wherein a shape of each of the plurality of chambers is (a) expanded in a state of the chamber in which air pressure in the chamber is atmospheric pressure and (b) contracted in a state of the chamber in which air pressure in the chamber is below atmospheric pressure; and a plurality of tubes, each of the tubes in fluid communication with a respective one of the plurality of chambers and including an inlet to which a source of suction is couplable to provide fluid communication between the inlet and the source of suction.

For some applications, apparatus is provided that includes the user device, the apparatus further including a pump couplable to the user device, the pump configured when coupled to the user device to selectively apply suction to at least one of the plurality of chambers.

For some applications, the user device is the footwear device, the footwear device including an insole body defining the plurality of chambers and shaped and sized to be placed in a shoe of a user.

For some applications, the user device is the footwear device, the footwear device including a shoe.

For some applications, the user device is the footwear device, the footwear device including a sock.

There is further provided, in accordance with some applications of the present invention, a user device selected from the group consisting of: a footwear device, a medical device, a mattress device, and a seat cushion, the user device including:

a plurality of chambers; and a selector valve, the selector valve including:

(i) a pump port to which a pressure apparatus is couplable, (ii) two or more interface ports each having a respective inlet and a respective outlet, wherein (a) the outlet of a first one of the interface ports is in fluid communication with a first one of the chambers and (b) the outlet of a second one of the interface ports is in fluid communication with a second one of the chambers, and (iii) a pressing surface configured to: (a) in a first position of the pressing surface, provide fluid communication between the pump port and the outlet of the first one of the interface ports and restrict fluid communication between the pump port and the outlet of the second one of the interface ports, and, at a different time, (b) in a second position of the pressing surface, provide fluid communication between the pump port and the outlet of the second one of the interface ports and restrict fluid communication between the pump port and the outlet of the first one of the interface ports.

For some applications, the pressing surface is a rotary pressing surface, the pressing surface configured to: (a) in a first rotational position of the pressing surface, provide fluid communication between the pump port and the inlet of the first one of the interface ports and restrict fluid communication between the pump port and the inlet of the second one of the interface ports, and, at a different time, (b) in a second rotational position of the pressing surface, provide fluid communication between the pump port and the inlet of the second one of the interface ports and restrict fluid communication between the pump port and the inlet of the first one of the interface ports.

For some applications, the selector valve is disposed at least partially within the user device.

For some applications, the user device is the footwear device, the footwear device including an insole body defining the plurality of chambers and shaped and sized to be placed in a shoe of a user.

For some applications, the user device is the footwear device, the footwear device including a shoe.

For some applications, the user device is the footwear device, the footwear device including a sock.

For some applications, a system is provided that includes the user device, the system further including the pressure apparatus, the pressure apparatus removably couplable to the user device and including:

a pump configured to couple to the pump port of the selector valve;

a motor configured to change the position of the pressing surface; and control circuitry configured to, when the pump is coupled to the pump port, actuate the pump to inflate or deflate the first and second chambers by:

(i) actuating the motor to position the pressing surface in the first position and while the pressing surface is in the first position actuating the pump to apply either positive or negative pressure to inflate or deflate the first one of the chambers to a first pressure, and subsequently (ii) actuating the motor to position the pressing surface in the second position and while the pressing surface is in the second position actuating the pump to apply either positive or negative pressure to inflate or deflate the second one of the chambers to a second pressure.

For some applications, the selector valve further includes a motor port to which the motor is couplable to change the position of the pressing surface.

There is further provided, in accordance with some applications of the present invention, a user device selected from the group consisting of: a footwear device, a medical device, a mattress device, and a seat cushion, the user device including:

one integral piece of elastomer that is shaped to define a plurality of selectively inflatable or deflatable chambers, each chamber shaped to define an orifice such that the one integral piece of elastomer forms (i) the orifice, (ii) an orifice-end wall of each chamber, and (iii) a flexible wall opposite the orifice-end wall of each chamber; and a plurality of plugs disposed, respectively, in the orifices of each of the plurality of chambers.

For some applications, the flexible wall of each chamber is expandable.

For some applications, the user device is the footwear device, the footwear device including an insole body shaped and sized to be placed in a shoe such that a surface of the insole body facing in an inferior direction faces the sole of the shoe.

For some applications, the user device is the footwear device, the footwear device including a shoe.

For some applications, the user device is the footwear device, the footwear device including a sock.

For some applications, each of the plurality of plugs includes a respective tube such that each tube is in fluid communication with a respective one of the plurality of chambers, wherein each tube includes an inlet to which a source of positive or negative pressure is couplable to selectively inflate or deflate the plurality of chambers to at least two different respective pressures.

For some applications, the orifice-end wall is thicker than the flexible wall, such that when a given chamber is inflated or deflated the thickness of the orifice-end wall inhibits movement of the orifice-end wall of the chamber.

For some applications, each plug includes a plug-head that is disposed against an interior surface of the orifice-end wall of each respective chamber, such that when a given chamber is inflated or deflated, movement of the orifice-end wall of the chamber toward the flexible wall that is opposite the orifice-end wall is inhibited by the plug-head.

For some applications, the user device further includes a plurality of supports, each support disposed, respectively, against an exterior surface of the orifice-end wall of each respective chamber, surrounding the orifice in the orifice-end wall, such that when the given chamber is inflated or deflated, movement of the orifice-end wall of the chamber away from the flexible wall that is opposite the orifice-end wall is inhibited by the support.

There is further provided, in accordance with some applications of the present invention, a method of manufacturing a user device selected from the group consisting of: a footwear device, a medical device, a mattress device, and a seat cushion, the method including:

placing a first plate in proximity to a second plate, the first plate shaped to define a plurality of heads that are each disposed on a respective post protruding from a top-side of the first plate;

injecting liquid elastomer between the first plate and the second plate such that the liquid elastomer surrounds each of the heads and each of the posts, and such that the liquid elastomer is enclosed between the first and second plates until the elastomer solidifies;

removing the second plate from the first plate;

removing the solidified elastomer from the first plate such that a respective chamber is defined in the solidified elastomer where the elastomer had surrounded each of the heads, each chamber shaped to define (i) an orifice, (ii) an orifice-end wall, and (iii) a flexible wall opposite the orifice-end wall; and inserting a respective plug into the orifice of each of the chambers.

For some applications, the method is a method for manufacturing the footwear device, the footwear device including an insole body sized and shaped to be placed in a shoe of a user.

For some applications, the method further includes sealing gaps between each plug and the orifice of the respective chamber in which the plug is disposed.

For some applications, inserting the respective plug into the orifice of each of the chambers includes inserting a respective plug that includes a plug-head into the orifice of each of the chambers such that the plug-head is disposed against an interior surface of the orifice-end wall of the chamber, such that when a given chamber is inflated or deflated, movement of the orifice-end wall of the chamber toward the flexible wall that is opposite the orifice-end wall is inhibited by the plug-head.

For some applications, the method further includes supporting an external surface of the orifice-end wall of each chamber, such that when the given chamber is inflated or deflated, movement of the orifice-end wall of the chamber away from the flexible wall that is opposite the orifice-end wall is inhibited.

There is further provided, in accordance with some applications of the present invention, a method of manufacturing a user device selected from the group consisting of: a footwear device, a medical device, a mattress device, and a seat cushion, the method including:

placing a first plate in proximity to a second plate, the first plate shaped to define a plurality of holes and including a plurality of removable inserts disposed respectively within in each hole, each insert shaped to have a head that is disposed on a top-side of the first plate;

injecting liquid elastomer between the first plate and the second plate such that the liquid elastomer surrounds the head of each of the removable inserts, and such that the liquid elastomer is enclosed between the first and second plates until the elastomer solidifies;

removing the second plate from the first plate;

removing the solidified elastomer from the first plate, whereby the removing of the solidified elastomer pulls the removable inserts out of the respective holes in the first plate; and removing the removable inserts from the solidified elastomer such that a respective chamber is defined in the solidified elastomer where the elastomer had surrounded each of the heads, each chamber shaped to define (i) an orifice, (ii) an orifice-end wall, and (iii) a flexible wall opposite the orifice-end wall; and inserting a respective plug into each of the chambers.

For some applications, the method is a method for manufacturing the footwear device, the footwear device including an insole body sized and shaped to be placed in a shoe of a user.

For some applications, the method further includes sealing gaps between each plug and the respective chamber in which the plug is disposed.

For some applications, inserting the respective plug into the orifice of each of the chambers includes inserting a respective plug that includes a plug-head into the orifice of each of the chambers such that the plug-head is disposed against an interior surface of the orifice-end wall of the chamber, such that when a given chamber is inflated or deflated, movement of the orifice-end wall of the chamber toward the flexible wall that is opposite the orifice-end wall is inhibited by the plug-head.

For some applications, the method further includes supporting an external surface of the orifice-end wall of each chamber, such that when the given chamber is inflated or deflated, movement of the orifice-end wall of the chamber away from the flexible wall that is opposite the orifice-end wall is inhibited.

There is further provided, in accordance with some applications of the present invention, insole apparatus, the apparatus including:

an insole body defining a plurality of chambers and shaped and sized to be placed in a shoe of a user;

circuitry, including at least one insole pressure sensor that is configured to measure pressure in the plurality of chambers; and a pump that is:

(a) couplable to the shoe and to the insole body by the user, such that the pump is wearable by the user while the user walks, the circuitry configured to actuate the pump when the pump is coupled to the insole body to selectively inflate the plurality of chambers to at least two different respective pressures, and (b) decouplable by the user from the shoe and from the insole body without the decoupling deflating the plurality of chambers of the insole body.

There is further provided, in accordance with an application of the present invention, insole apparatus, the apparatus including:

an insole body defining a plurality of chambers and shaped and sized to be placed in a shoe having a sole, such that a surface of the insole body facing in an inferior direction faces the sole of the shoe; and a plurality of valves, each of the valves:

(a) in fluid communication with a respective one of the plurality of chambers, and (b) including an inlet to which a source of positive pressure is couplable to facilitate filling of the respective one of the plurality of chambers, the inlet facing in the inferior direction.

There is further provided, in accordance with an application of the present invention, insole apparatus, the apparatus including:

an insole body defining a plurality of chambers and shaped and sized to be placed in a shoe;

a selector valve including a pump port and two or more additional ports, a first one of the additional ports coupled to a first one of the chambers and a second one of the additional ports coupled to a second one of the chambers;

a pump coupled to a pump port of the selector valve; and circuitry configured to actuate the pump to inflate the first and second chambers by activating the selector valve to provide fluid communication (a) between the first additional port and the pump, and, at a different time, (b) between the second additional port and the pump.

There is further provided, in accordance with an application of the present invention, insole apparatus, the apparatus including:

an insole body defining a plurality of chambers and shaped and sized to be placed in a shoe;

a selector valve including a pump port and two or more additional ports, a first one of the additional ports coupled to a first one of the chambers and a second one of the additional ports coupled to a second one of the chambers; and circuitry, including a pump pressure sensor that is coupled to a pump port of the selector valve, the circuitry configured to measure pressure in the first and second chambers by activating the selector valve to provide fluid communication (a) between the first additional port and the pump pressure sensor, and, at a different time, (b) between the second additional port and the pump pressure sensor.

There is further provided, in accordance with an application of the present invention, insole apparatus, the apparatus including:

an insole body defining a plurality of chambers and shaped and sized to be placed in a shoe of a user;

circuitry, including an insole pressure sensor that is configured to measure pressure in the plurality of chambers; and a pump:

(a) couplable to the shoe and to the insole body by the user, the pump configured when coupled to the insole body to selectively inflate the plurality of chambers to at least two different respective pressures, (b) decouplable by the user from the shoe and from the insole body without the decoupling deflating the plurality of chambers of the insole body, and (c) including a pump pressure sensor, the circuitry is configured to actuate the insole pressure sensor to measure the pressure in the plurality of chambers at least when the pump is not coupled to the insole body, and the pump is configured to use pressure measurements from the pump pressure sensor during inflation of the plurality of chambers to regulate the inflation of the plurality of chambers.

There is further provided, in accordance with an application of the present invention, an insole body:

defining a plurality of chambers; and including a resilient base on which the plurality of chambers are disposed, and in the absence of any forces applied to the resilient base a height of an upper surface of the resilient base under a first one of the chambers is higher than a height of the upper surface of the resilient base under a second one of the chambers.

The present invention will be more fully understood from the following detailed description of applications thereof, taken together with the drawings, in which:

DETAILED DESCRIPTION

Figure 1:
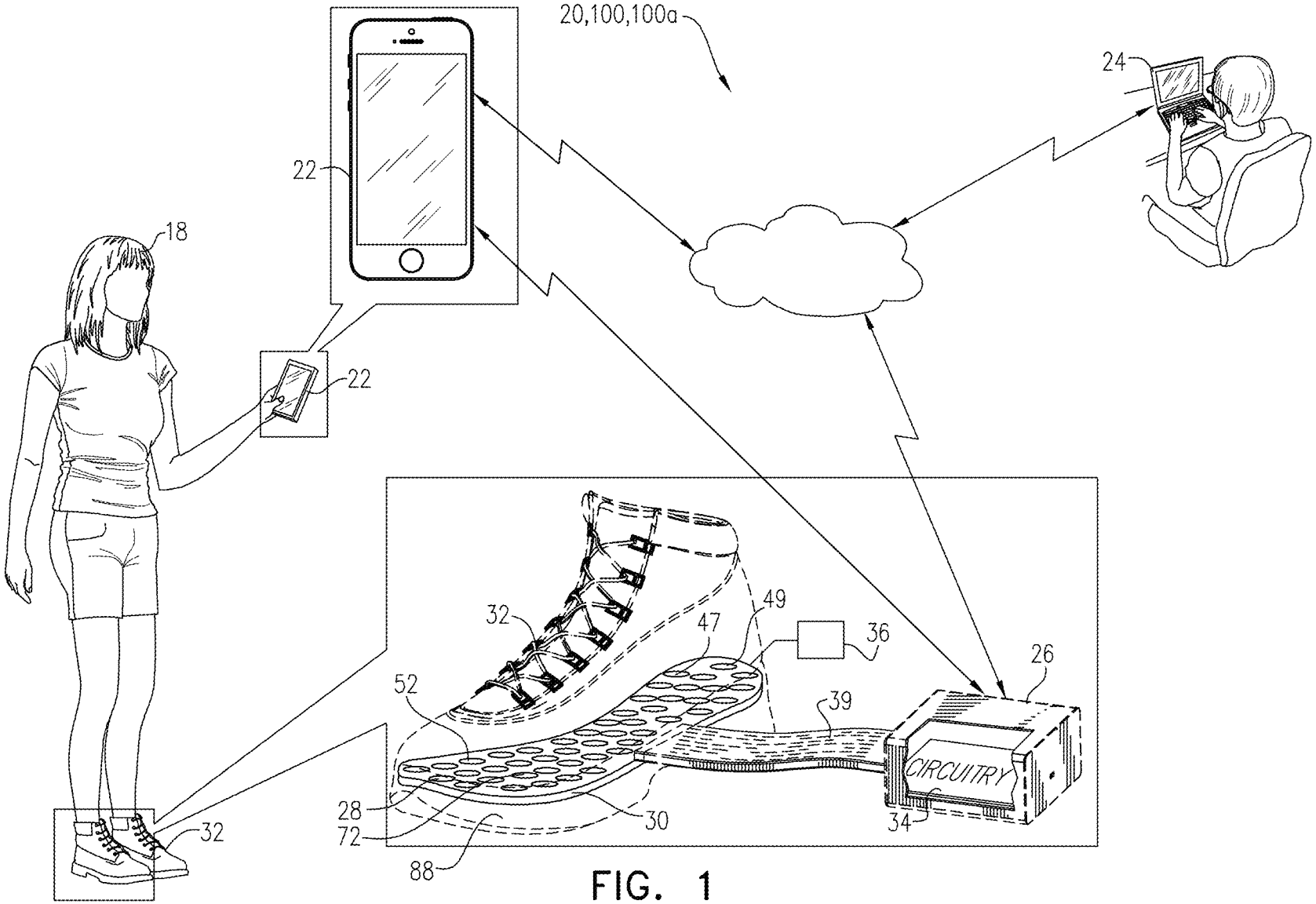
FIGS. 1-2 are schematic illustrations of an insole apparatus, in accordance with some applications of the present invention.
Figure 2:
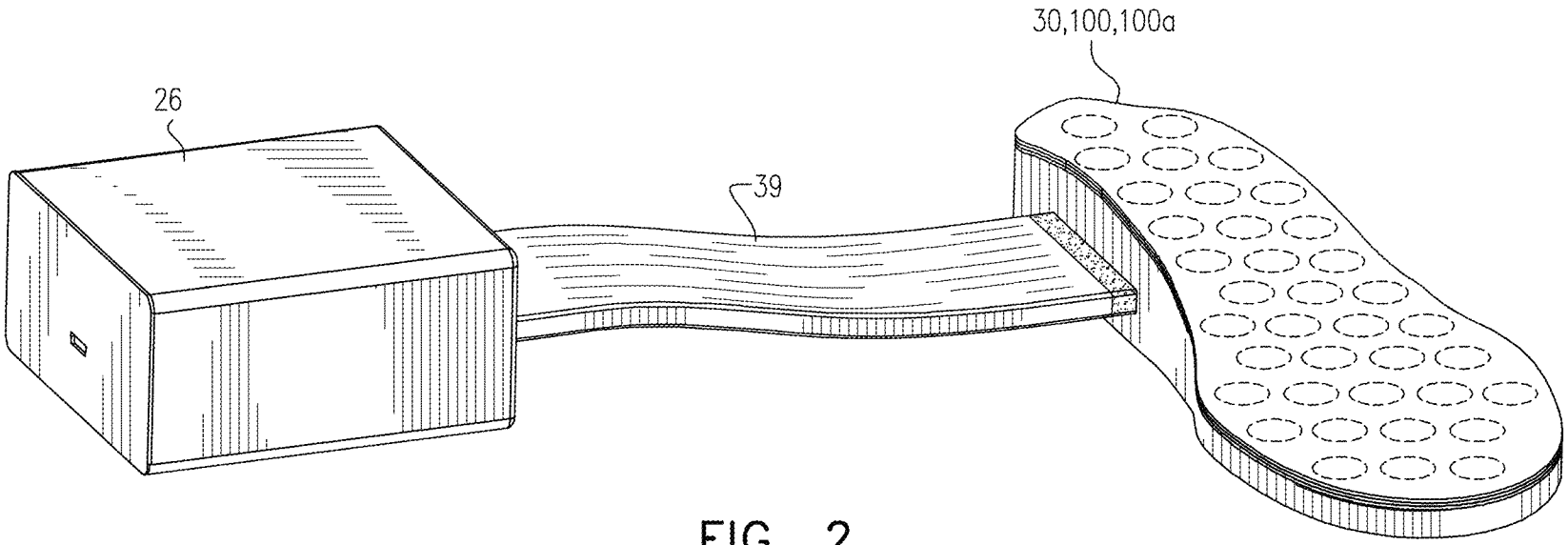

FIGS. 1-2 are schematic illustrations of a user device 100 shaped to define a plurality of chambers 28. For example, user device 100 may be an insole apparatus 20, a shoe, or a sock, in accordance with some applications of the present invention. As further described hereinbelow with respect to FIG. 26, user device 100 may be a footwear device 100*a*, a medical device 100*b*, a mattress device 100*c*, or a seat cushion 100*d*. By way of example, the features of FIGS. 1-2 are described hereinbelow with respect to insole apparatus 20. Typically, insole apparatus 20 treats a user such as a patient 18 by selectively inflating plurality of chambers 28 to enable ease of walking. For example, patient 18 may have a lesion on the plantar surface of her foot, and it may be desirable to reduce pressure applied to the lesion.

Typically, insole apparatus 20 comprises an insole body 30 which is of a suitable shape and size to be placed within a shoe 32 of a user.

Circuitry 34 is typically disposed within a control unit 26. Typically, a pump 38 (FIG. 3) is disposed within control unit 26 and couplable to insole body 30 by the user, such that pump 38 along with the rest of the control unit is wearable by the user while the user walks. For such applications, control unit 26 is typically smaller than as shown in FIG. 1, and is provided with a coupling mechanism (e.g., a clip or a clasp) that attaches control unit 26 to shoe 32. Typically, circuitry 34 actuates pump 38, when pump 38 is coupled to insole body 30 via a set of one or more tubes 39, to selectively inflate or deflate different ones of chambers 28 to at least two different respective pressures.

Figure 3:
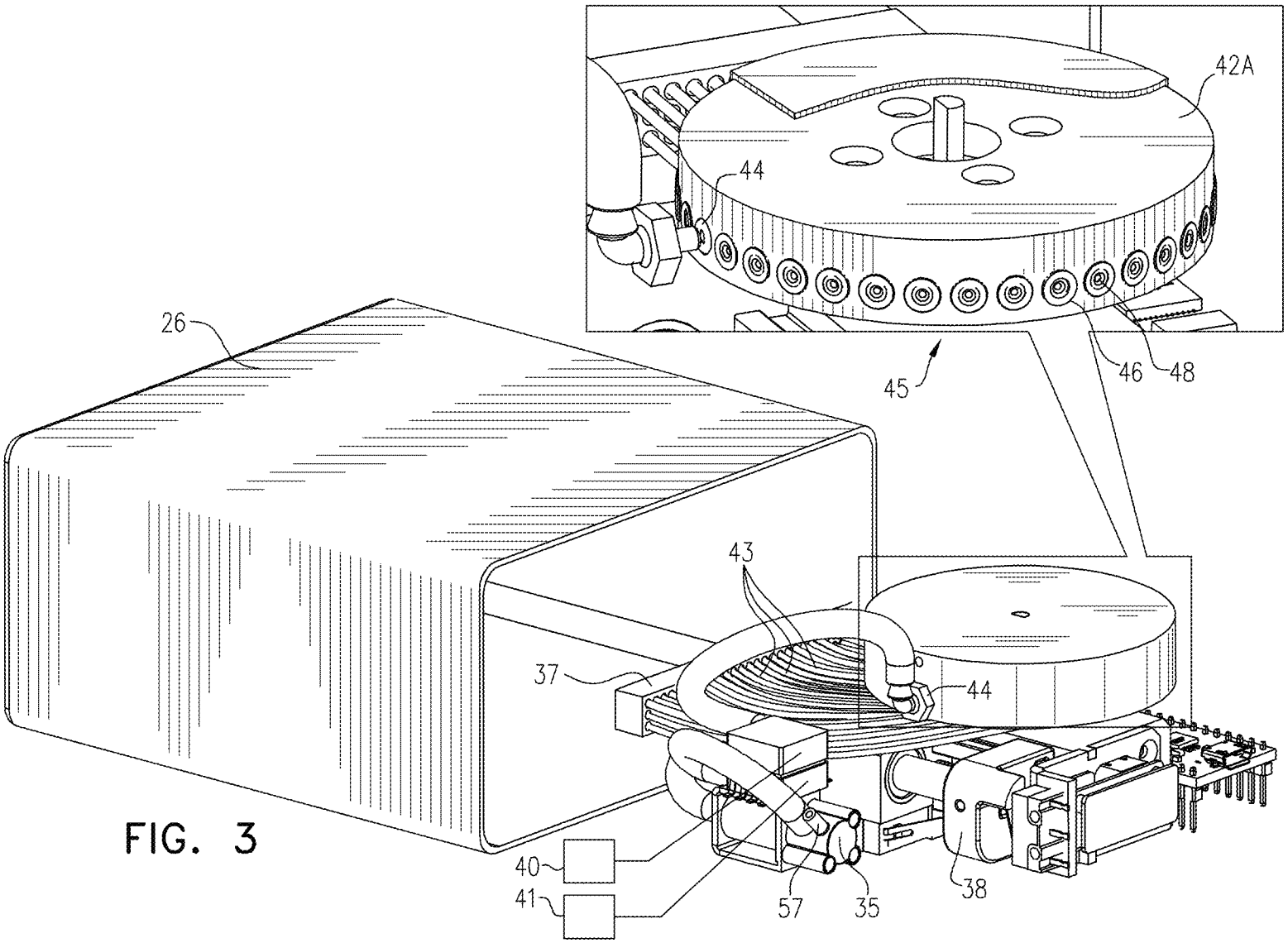
FIG. 3 is a schematic illustration that depicts a selector valve, disposed within the casing of a control unit, in accordance with some applications of the present invention.

In some applications of the present invention, pump 38 comprises a pump pressure sensor 40 and/or a flow sensor 41 coupled to a pump port 44 (FIG. 3). (Pump port 44 therefore is coupled between pump pressure sensor 40 and/or flow sensor 41 and selector valve 42A.) Pump 38 uses pressure measurements from pump pressure sensor 40 during the inflation or deflation of plurality of chambers 28 to regulate the inflation or deflation of plurality of chambers 28.

Pump 38 is typically decouplable by the user from insole body 30 without the decoupling affecting the respective pressures in plurality of chambers 28 of user device 100, e.g., footwear device 100*a*, e.g., insole body 30. For example, for some applications, plurality of chambers 28 is selectively inflated to at least two different respective pressures and pump 38 is decouplable by the user from insole body 30 without the decoupling deflating chambers 28. Typically, circuitry 34 (or other circuitry, not shown) actuates at least one device pressure sensor, e.g., insole pressure sensor 36, to measure the pressure in chambers 28 at least when pump 38 is not coupled to user device 100, e.g., footwear device 100*a*, e.g., insole body 30. By way of illustration and not limitation, insole pressure sensor 36 may be integrated into insole body 30, disposed within control unit 26, or, alternatively, coupled to insole body 30 by a lead and, for example, clipped or otherwise attached to shoe 32 while user 18 wears the shoe.

For some applications, insole apparatus 20 communicates with an application on the user's mobile device 22, which in turn communicates with a corresponding application on the device of a medical professional 24. For example, insole apparatus 20 may send device diagnostic data and/or patient diagnostic data to medical professional 24, and medical professional 24 may send instructions to insole apparatus 20 (such as to change an inflation or deflation level of one or more of chambers 28).

For some applications, user device 100 is a footwear device 100*a* (FIG. 26), e.g., insole body 30, a shoe (e.g., shoe 32), or a sock. For some applications, control unit 26 including circuitry 34 and pump 38 may be packaged for commercial sale separately from user device 100. Alternatively, for some applications, user device 100 is sold commercially together with control unit 26 as a system.

For some applications, user device 100 is a shoe, e.g., shoe 32 of a user. Typically, plurality of chambers 28 are disposed on an interior part of the shoe on which the user's foot rests while the shoe is in use. As described hereinabove, pump 38 is (a) couplable to the shoe by the user such that the pump is wearable by the user while the user walks, and (b) decouplable by the user from the shoe without the decoupling affecting the respective pressures in plurality of chambers 28.

Reference is now made to FIG. 3, which depicts a selector valve 42A, disposed within the casing of control unit 26, in accordance with some applications of the present invention. Selector valve 42A comprises a pump port 44 and two or more additional ports 45. A first one of the additional ports 46 is coupled to a first one of the chambers 47 (FIG. 1) via one of tubes 43, and, a second one of the additional ports 48 is coupled to a second one of the chambers 49 via another one of tubes 43. Tubes 43 may be longer than as depicted, and converge into a plug 37 that may be coupled to user device 100, e.g., footwear device 100*a*, e.g., insole body 30 (e.g., as shown in FIG. 1). Pump 38 is coupled to pump port 44. For example, circuitry 34 of insole apparatus 20 may actuate pump 38 to inflate or deflate first and second chambers 47 and 49 by activating selector valve 42A to provide fluid communication (a) between pump 38 and first additional port 46, and, at a different time, (b) between pump 38 and second additional port 48. This selective control allows pump 38 to inflate first and second chambers 47 and 49 (as well as all of the other chambers) at different respective times. Typically but not necessarily, pump 38 is coupled to pump port 44 of selector valve 42A via a solenoid valve 35. Selector valve 42A may also comprise a release port 57.

Pump pressure sensor 40 is coupled to pump 38 and to pump port 44. Circuitry 34 measures pressure in the first and second chambers 47 and 49 by activating selector valve 42A to provide fluid communication (a) between first additional port 46 and pump pressure sensor 40, and, at a different time, (b) between second additional port 48 and pump pressure sensor 40.

Figure 4:
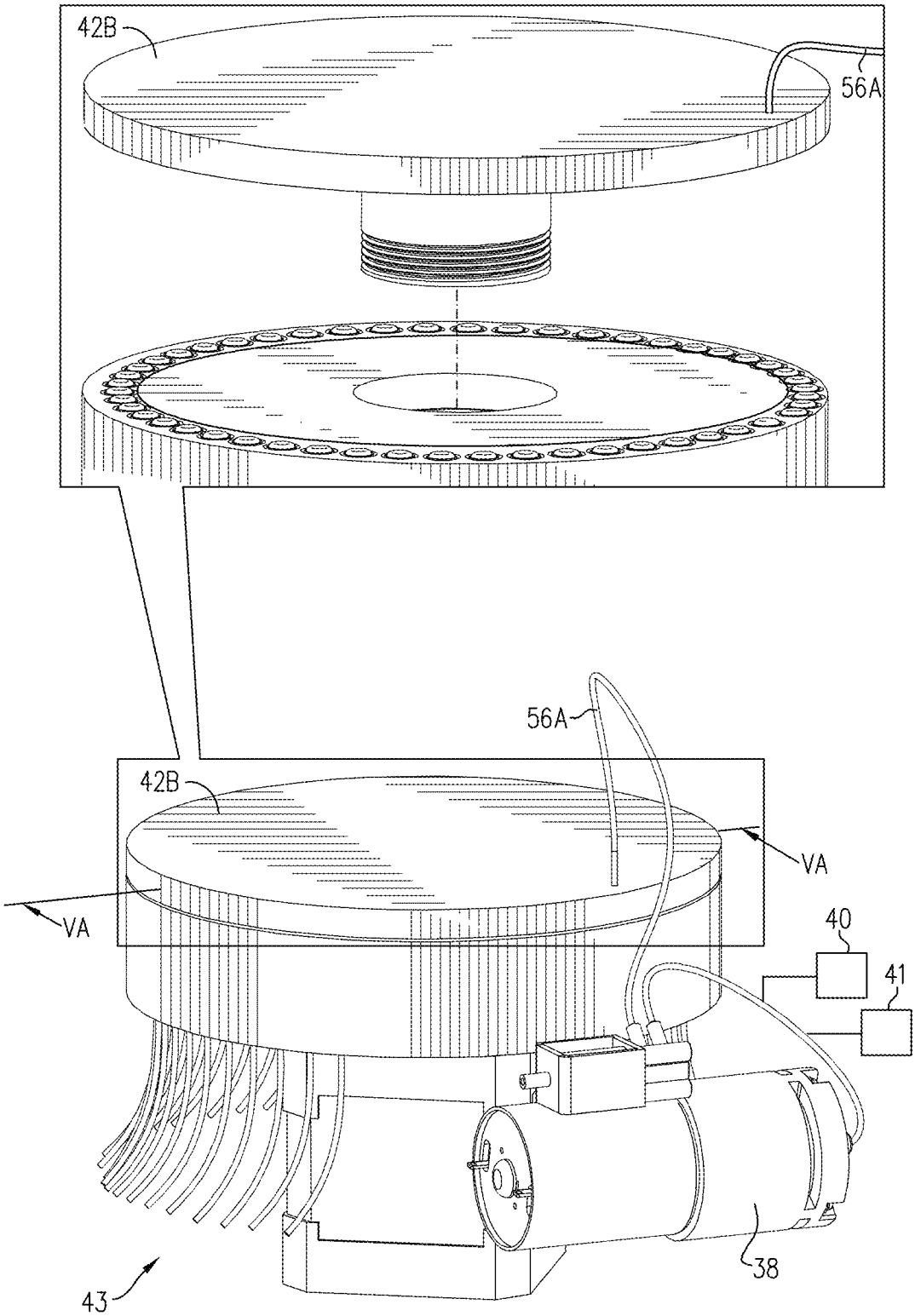
FIGS. 4 and 5A-5B are schematic illustrations that depict different views of the selector valve, in accordance with some applications of the present invention.
Figure 5A:
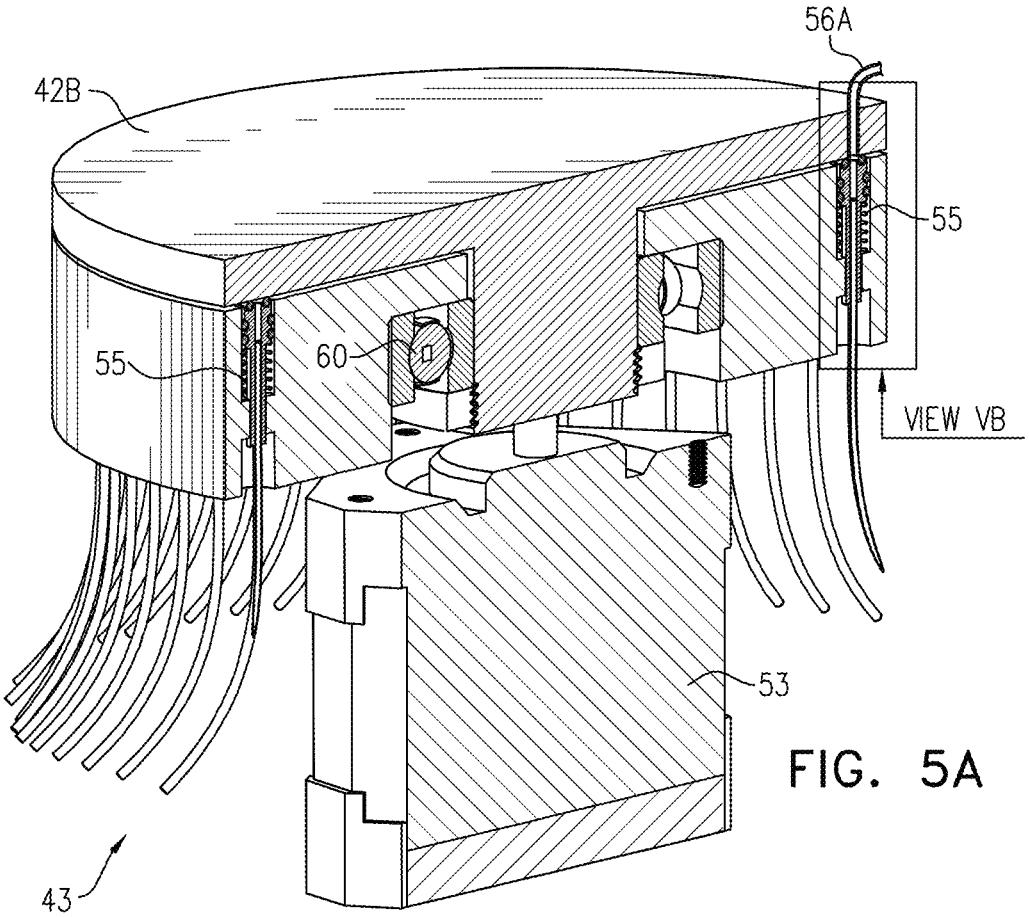
Figure 5B:
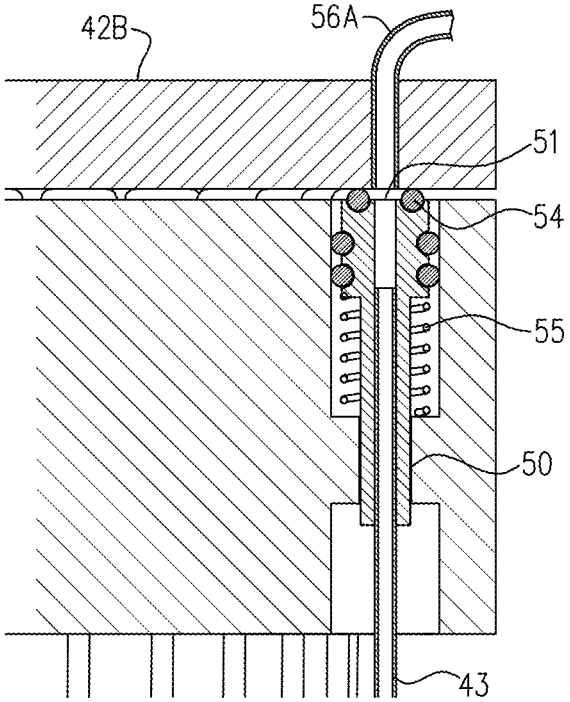

Reference is now made to FIGS. 4 and 5A-5B, which depict different views of a selector valve 42B, in accordance with some applications of the present invention. As described hereinbelow, pressure is applied to a port 51 that is coupled to an associated chamber 52 of user device 100, e.g., footwear device 100*a*, e.g., insole body 30, via a conduit 50. In order to allow for the movement of air from pump 38 through selector valve 42B, a rotatable component of a stepper motor 53 of selector valve 42B rotates in order to align a pump output tube 56A with port 51. This allows for the free movement of air (or any other fluid) from pump 38 to port 51, to conduit 50, and then through a tube 43 that is in fluid communication with associated chamber 52, thereby inflating associated chamber 52 (FIG. 1). A spring 55 facilitates an air tight seal being maintained between port 51 and the rotatable component of stepper motor 53, and between port 51 and pump output tube 56A upon the alignment of port 51 and pump output tube 56A. Ball bearings 60 at the base of the selector valve allow for rotation with minimal friction.

Figure 6:
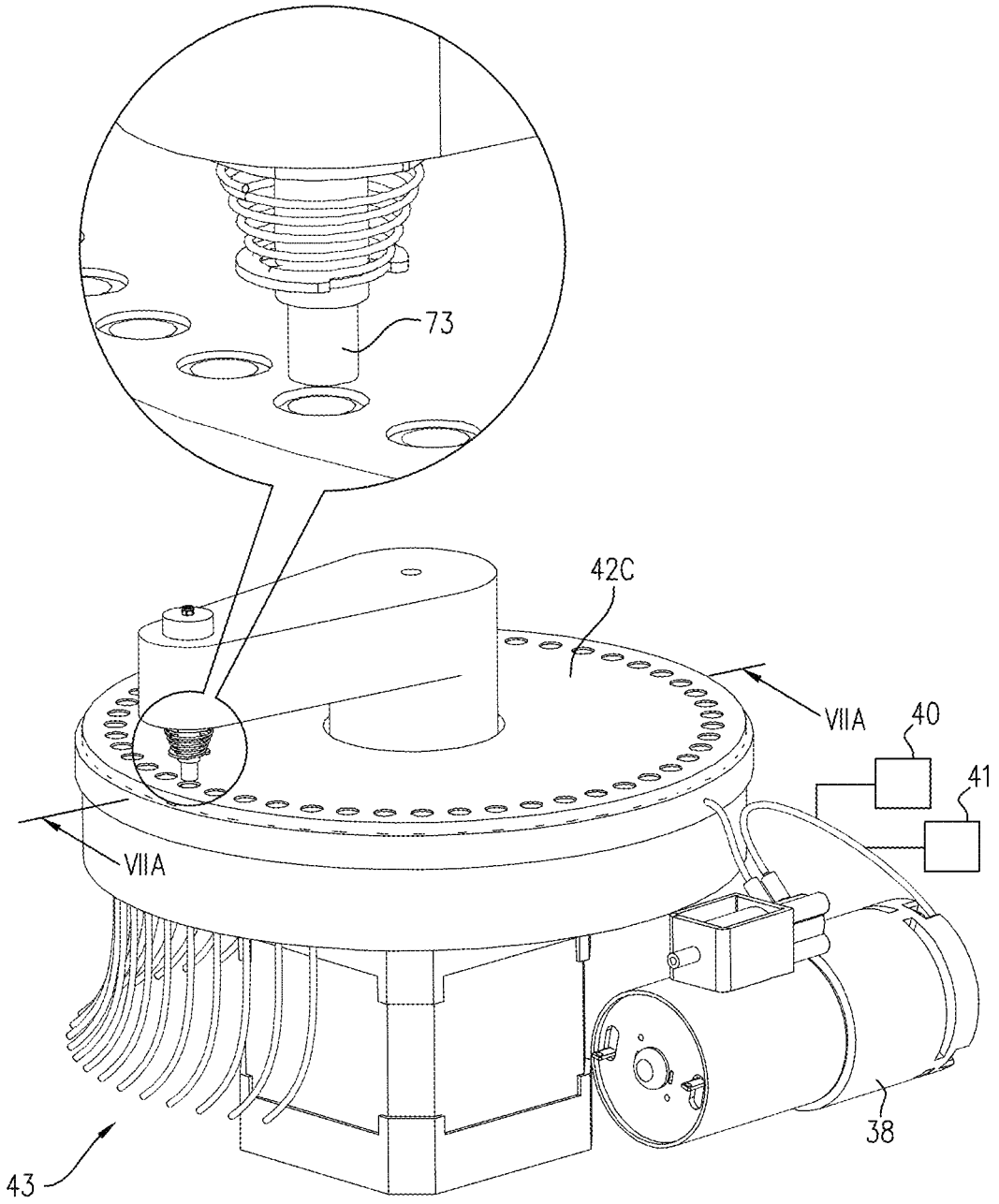
FIGS. 6 and 7A-7B are schematic illustrations that depict different views of an alternative piston-based inflation mechanism, in accordance with some applications of the present invention.
Figure 7A:
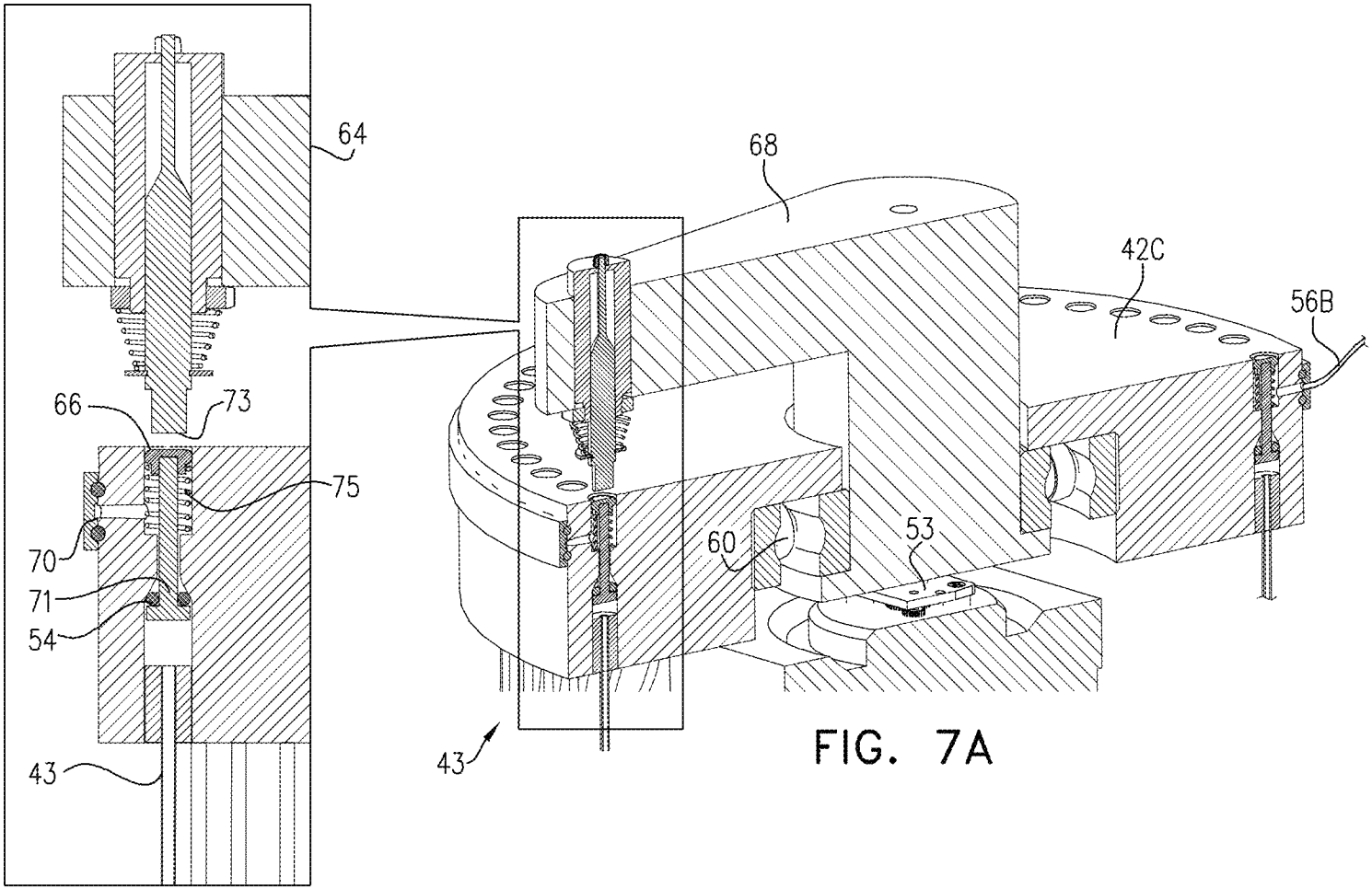
Figure 7B:
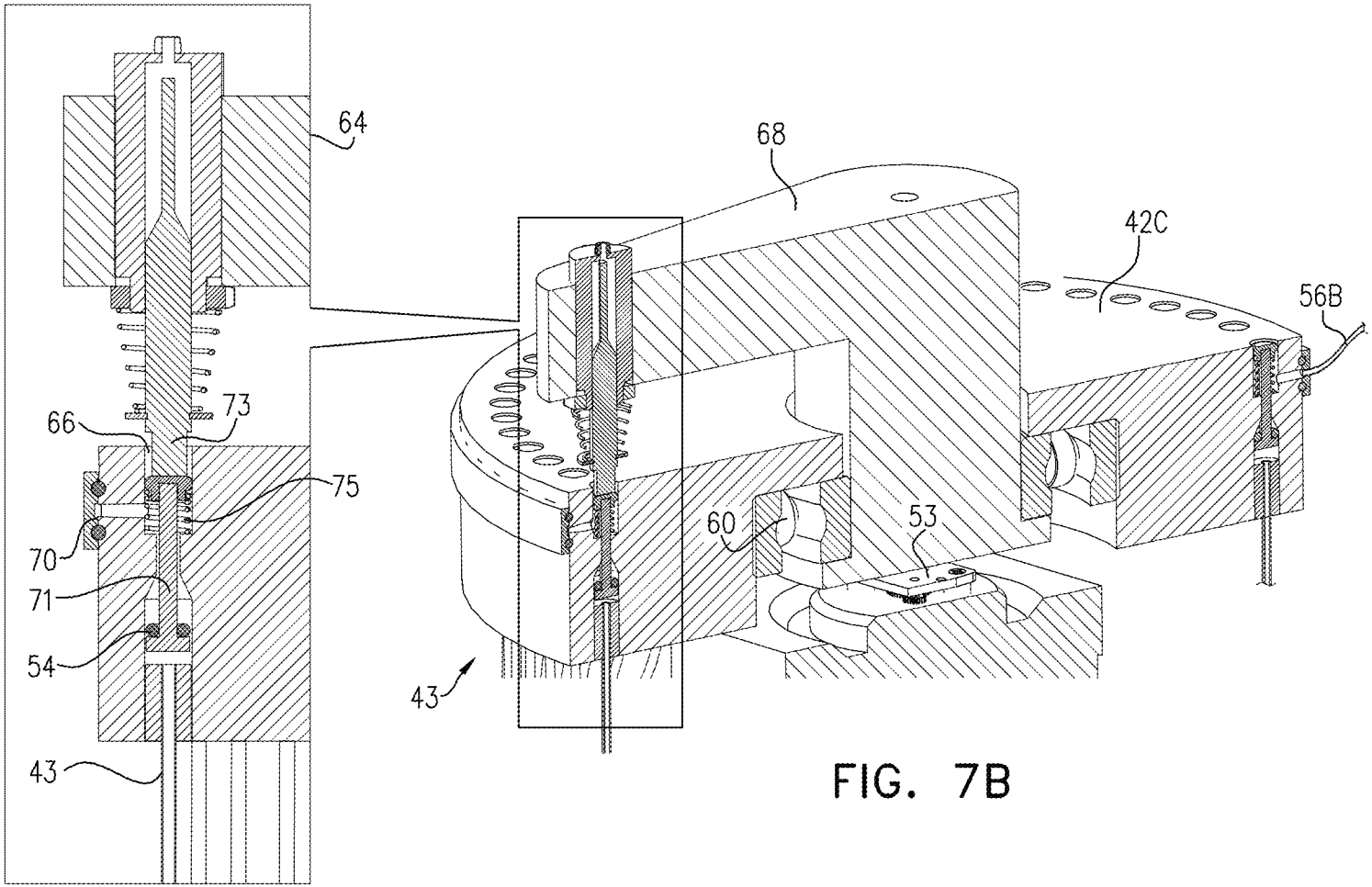

Reference is now made to FIGS. 6-7B, which depict an alternative selector valve 42C, in accordance with some applications of the present invention. As shown in FIG. 7A, a pump output tube 56B allows air to move from pump 38 through selector valve 42C. A lateral port 70 conveys this pressure to a cavity 75 of a port 66 of selector valve 42C. The air tight seal provided by O-ring 54 that surrounds a rod 71 passing through port 66 prevents the movement of air from lateral port 70 through cavity 75 to a tube 43, and thereby prevents the inflation of an associated chamber 72.

As shown in FIG. 7B, in order to allow for the movement of air from pump 38 through selector valve 42C, air moves through lateral port 70. The airtight seal provided by O-ring 54 which surrounds rod 71 is broken upon the application of a force provided to rod 71 by a piston 73 incorporated into a rotatable arm 68. This allows air to move from pump 38 via a pump output tube 56B through tube 43, thereby inflating associated chamber 72.

Figure 8:
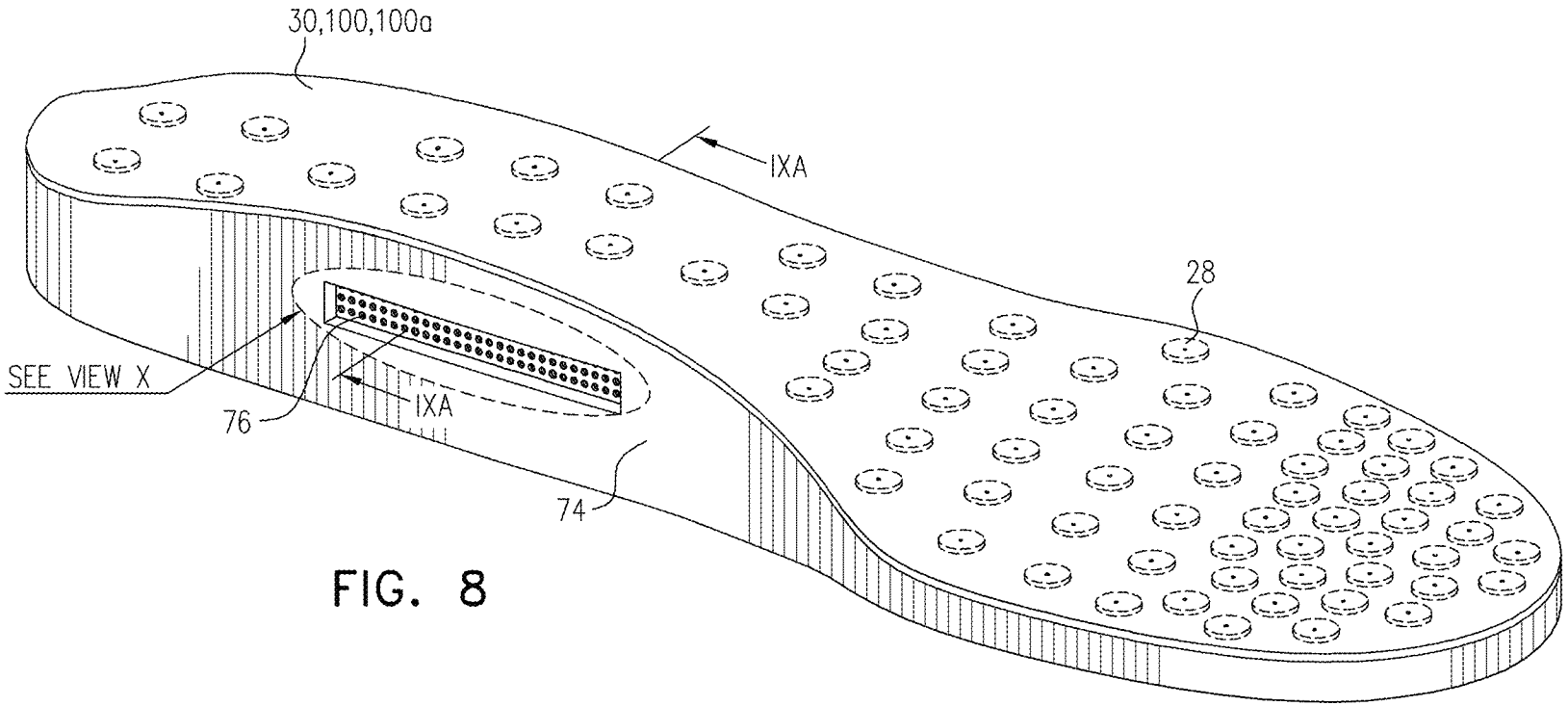
FIG. 8 is a schematic illustration that depicts an insole body, in accordance with some applications of the present invention.

Reference is now made to FIG. 8, which depicts user device 100, e.g., footwear device 100*a*, e.g., insole body 30, in accordance with some applications of the present invention. Typically, insole body 30 comprises a resilient base 74 on which chambers 28 are disposed. Typically, in the absence of any forces applied to resilient base 74, a height of an upper surface of resilient base 74 under a first one of the chambers is higher than a height of the upper surface of resilient base 74 under a second one of the chambers. This difference in height allows chambers 28 to be inflated to their proper operational heights using less air (or any other fluid) and in a lower amount of time than if the upper surface of the base were of a uniform height. Additionally, a default supportive contour is provided to the user's foot, even in the absence of inflation of any of the chambers of insole body 30.

Typically, insole apparatus 20 comprises an inlet 76 to which a source of positive or negative pressure (e.g., pump 38) is couplable to facilitate inflating or deflating of the respective ones of plurality of chambers 28. Inlet 76 is typically compatible with selector valves 42A, 42B, and 42C, described hereinabove with reference to FIGS. 3, 4, 5A-5B, 6, and 7A-7B.

Figure 9A:
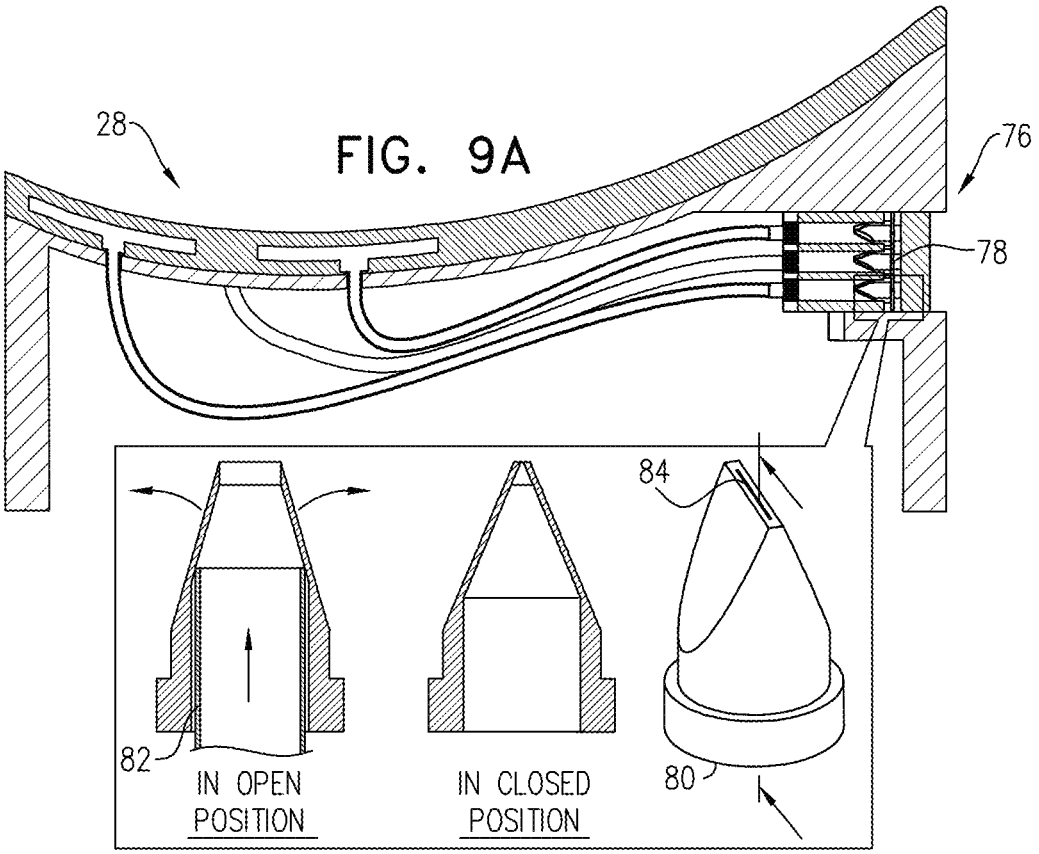
FIGS. 9A-9B are schematic illustrations which depict the inflation of the plurality of chambers of the insole apparatus, in accordance with some applications of the present invention.
Figure 9B:
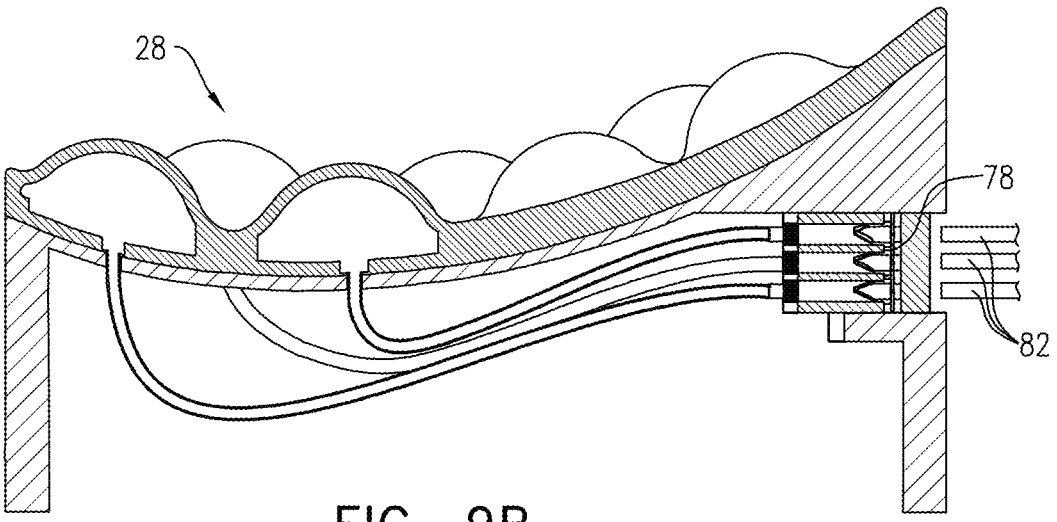

Reference is now made to FIGS. 9A-9B, which depict the inflation of plurality of chambers 28, in accordance with some applications of the present invention. FIG. 9A depicts the cross-section marked IXA in FIG. 8. Insole apparatus 20 comprises a plurality of flow-control elements such as valves 78, with each of the valves being in fluid communication with a respective one of the plurality of chambers 28. Valves 78 are typically but not necessarily duckbill valves, and allow air (or any other fluid) to enter through an open side 80 via a tube 82 and inflate the associated plurality of chambers 28. When tube 82 is removed from valve 78, the downstream end 84 of the valve remains closed, thereby maintaining the pressure in the associated chamber 28.

Figure 10:
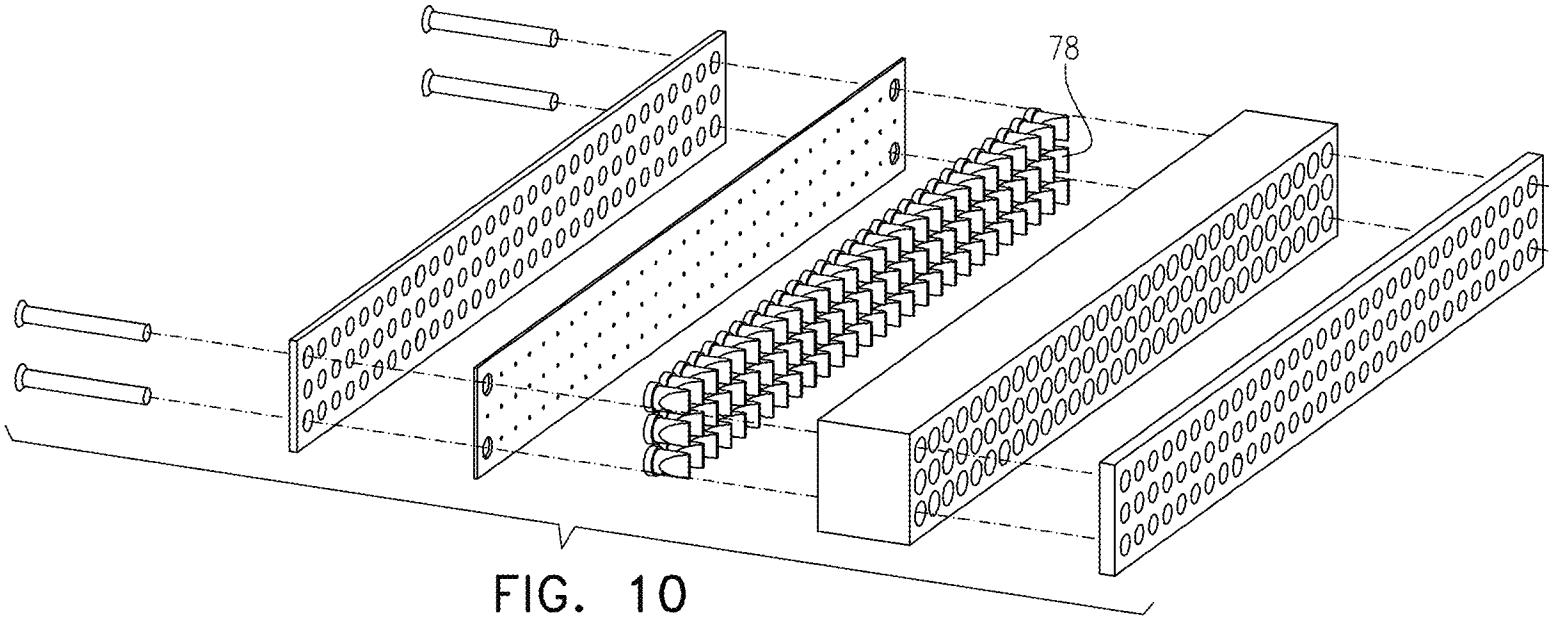
FIG. 10 is a schematic illustration which depicts a plurality of valves of the insole apparatus, in accordance with some applications of the present invention.

FIG. 10 is a schematic illustration which depicts an assembly of valves 78 disposed in inlet 76, in accordance with some applications of the present invention. As shown, valves 78 connect to chambers 28 from the medial direction (as shown in FIGS. 9A-9B).

Figure 11A:
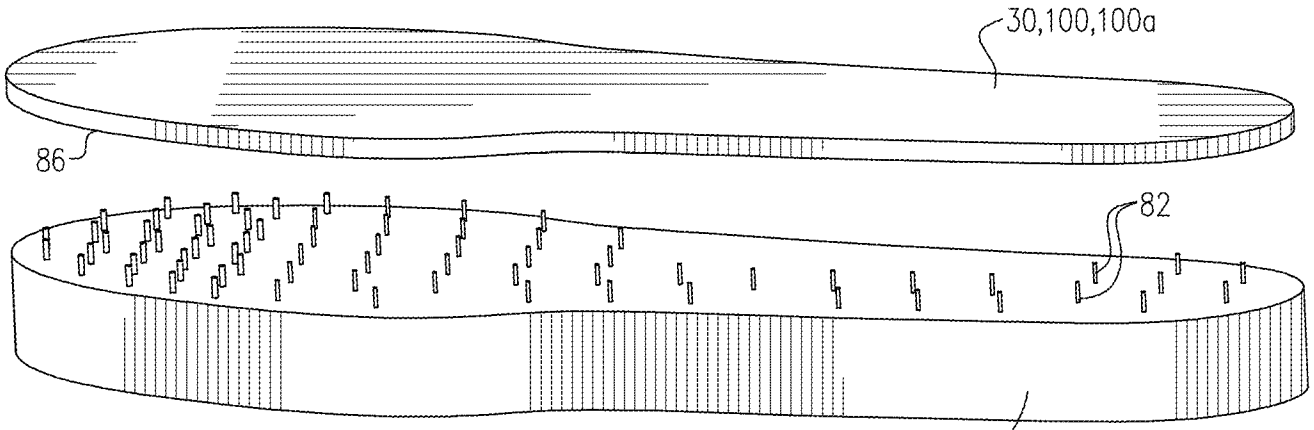
FIGS. 11A-11B are schematic illustrations which depict a plurality of valves of the insole apparatus, in accordance with some applications of the present invention.
Figure 11B:
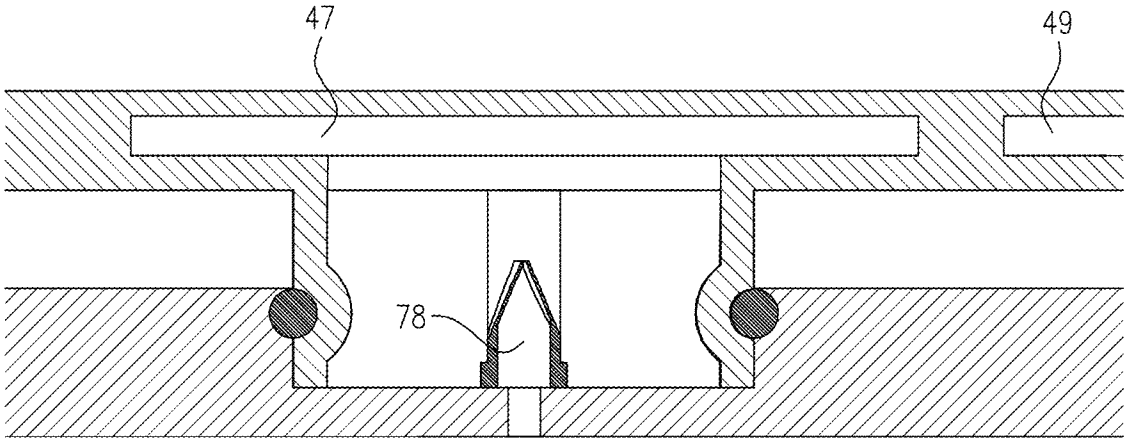

FIGS. 11A-11B are schematic illustrations which depict an assembly of valves 78, in accordance with some applications of the present invention. An inferior surface 86 of user device 100, e.g., footwear device 100*a*, e.g., insole body 30, facing in an inferior direction faces a sole 88 of shoe 32 (FIG. 1). FIG. 11B shows one of these valves 78, which is in fluid communication with chamber 47 via an inlet facing in the inferior direction, and which can be placed in fluid communication with pump 38 when insole body 30 is coupled to a pump interface 90. A plurality of tubes 82 of pump interface 90 can be coupled to corresponding chambers 28 on insole body 30 via respective ones of valves 78 to facilitate the inflation of chambers 28 using techniques described hereinabove.

Reference is now made to FIGS. 12A-D, 13A-B, and 14, which depict user device 100, e.g., footwear device 100*a*, e.g., insole body 30, and a lock 102 for controlling fluid communication to plurality of chambers 28, in accordance with some applications of the present invention. Typically, user device 100 has a plurality of tubes 104, each tube 104 in fluid communication with a respective one of plurality of chambers 28. Each tube 104 has an inlet 106 to which a source of positive or negative pressure, e.g., pump 38, is couplable to selectively inflate or deflate the plurality of chambers to at least two different respective pressures.

Figure 12A:
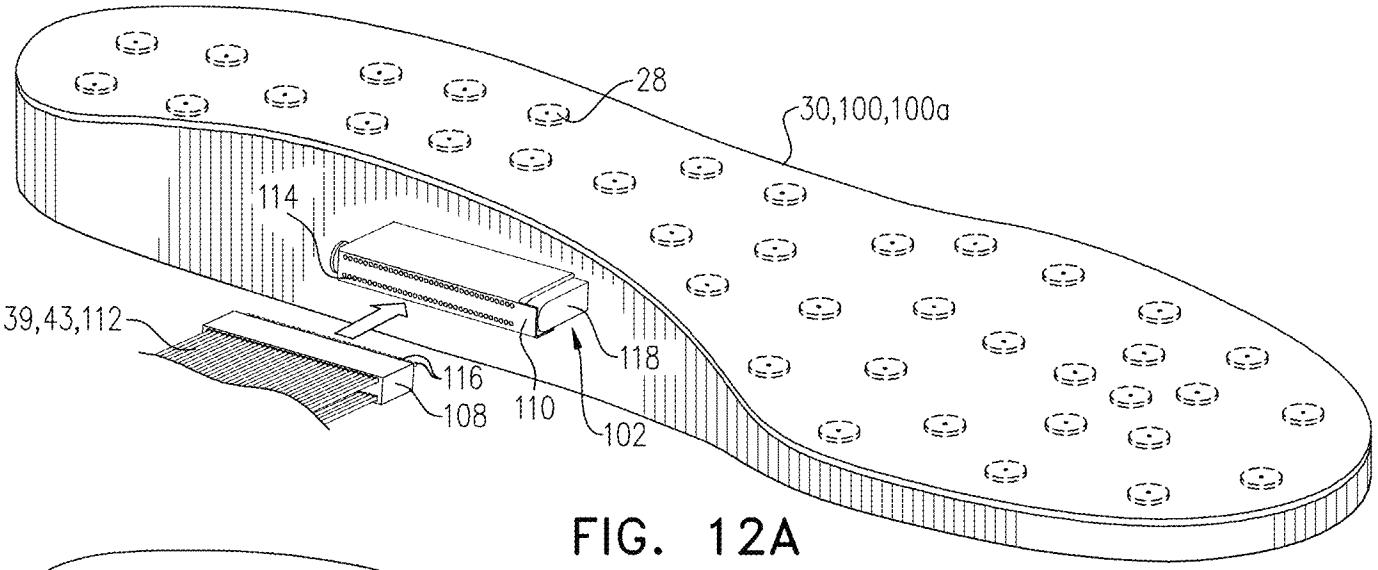
FIGS. 12A-D, 13A-B, and 14 depict a user device and a lock for controlling fluid communication to a plurality of chambers, in accordance with some applications of the present invention.
Figure 12B:
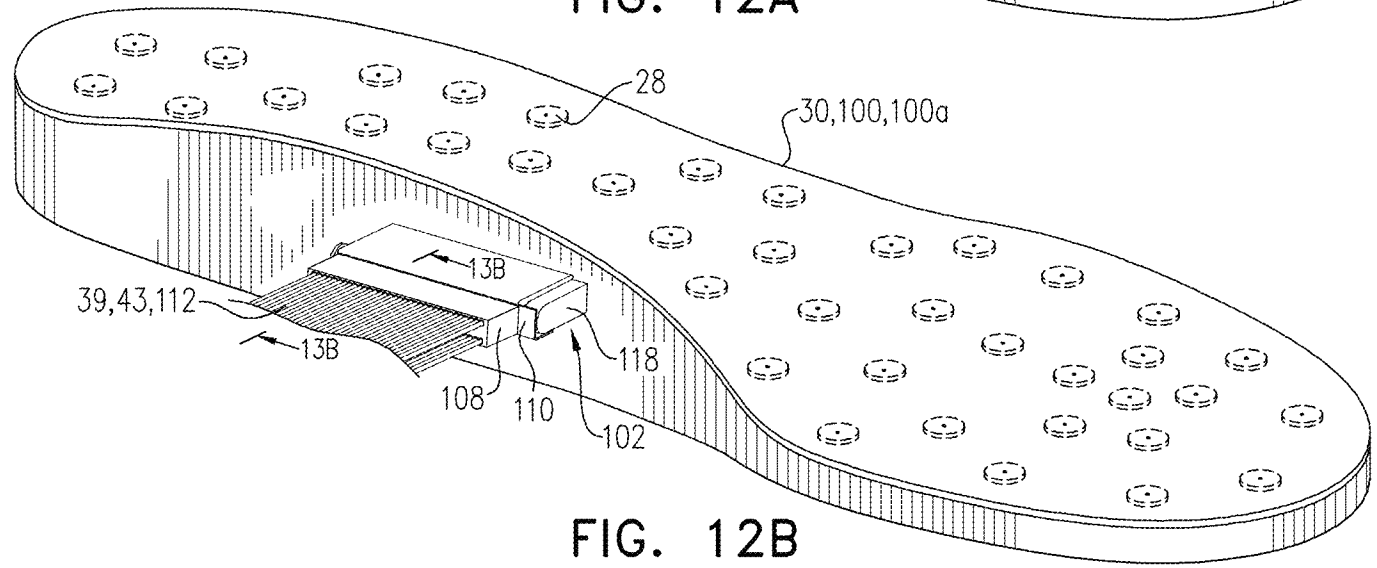
Figure 13A:
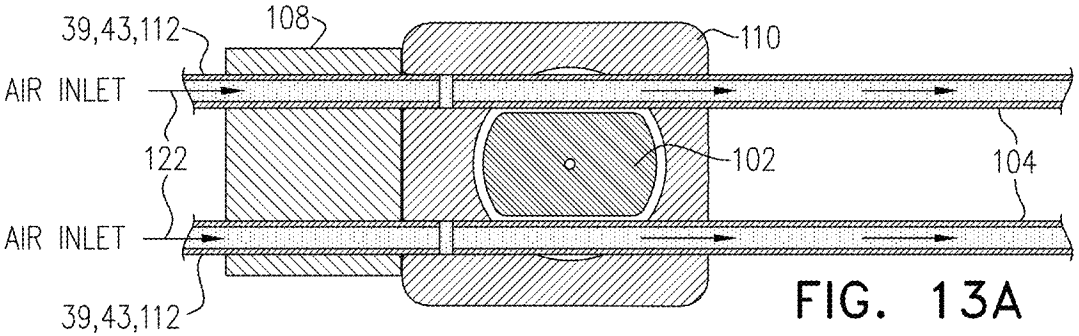
Figure 13B:
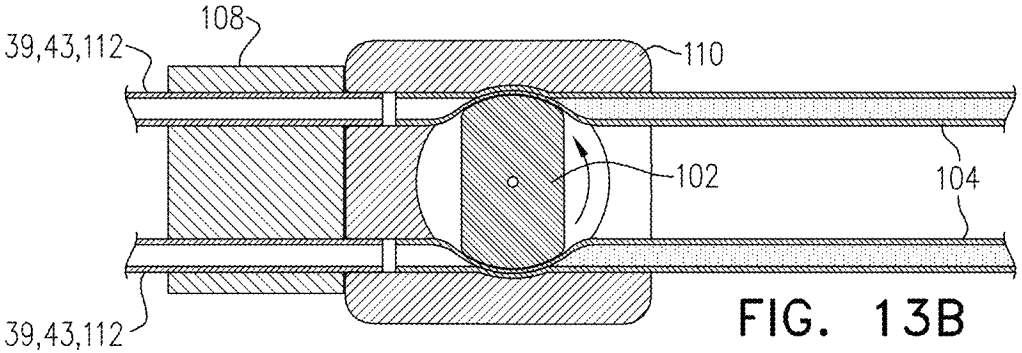
Figure 14:
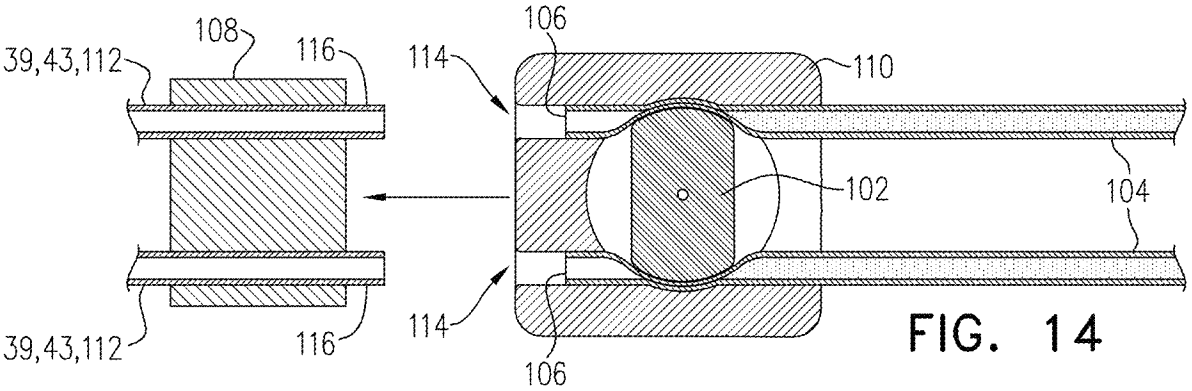

For some applications, lock 102 has a lock housing 110. Lock housing 110 has a plurality of channels through which tubes 104 are disposed such that each inlet 106 of a respective tube 104 is disposed near an opening 114 of a respective channel in lock housing 110 (such as is shown in FIGS. 13A-B, and 14). Openings 114 are shown in FIG. 12A as two rows of small holes in lock housing 110, each opening allowing fluid access to a respective inlet 106 of a tube 104. A pump connector 108 includes a respective plurality of pump tubes 112, e.g., tubes 39 as shown in FIG. 2, or tubes 43 of the selector valve. Each pump tube 112 has an interface end 116, e.g., a rigid interface end, that protrudes from pump connector 108. When pump connector 108 is coupled to lock housing 110 (depicted by the transition from FIG. 12A to 12B), each interface end 116 of a respective pump tube 112 is inserted into a respective opening 114, thereby establishing fluid communication between (i) the interface end 116 of each pump tube 112 and (ii) the respective inlet 106 of each tube 104. It is noted that the insertion of each interface end 116 into a respective opening 114 creates a pneumatic seal between interface end 116 and opening 114 such that air flowing from pump tube 112 into inlet 106 of tube 104 (or vice versa) does not leak.

Figure 12C:
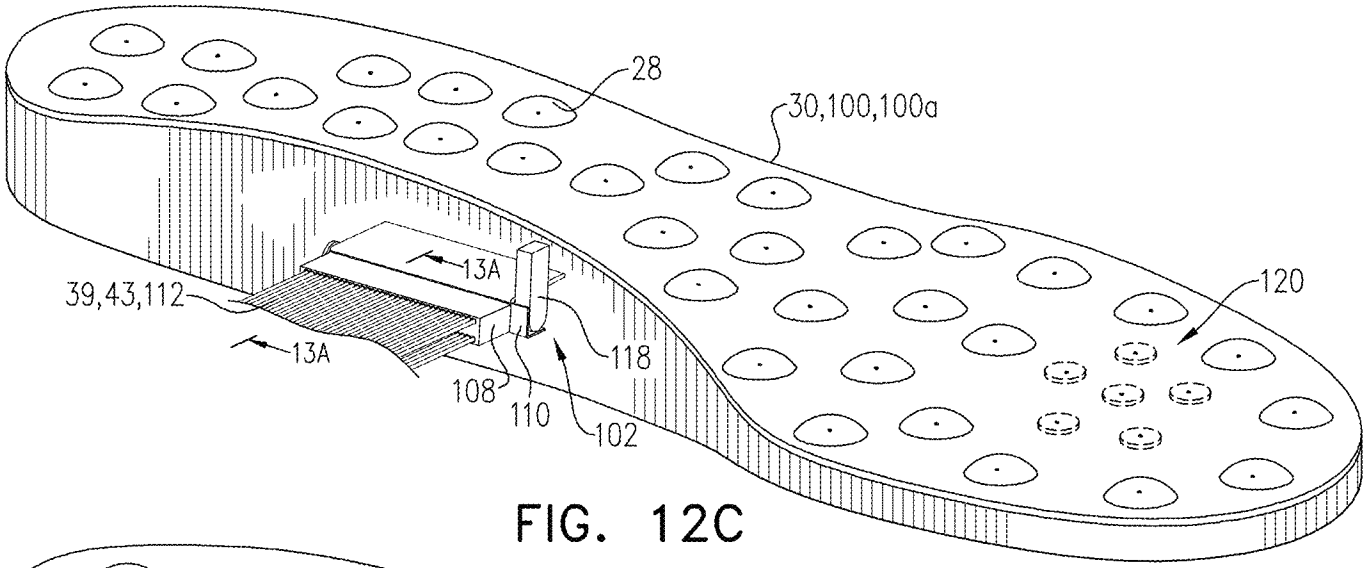
Figure 12D:
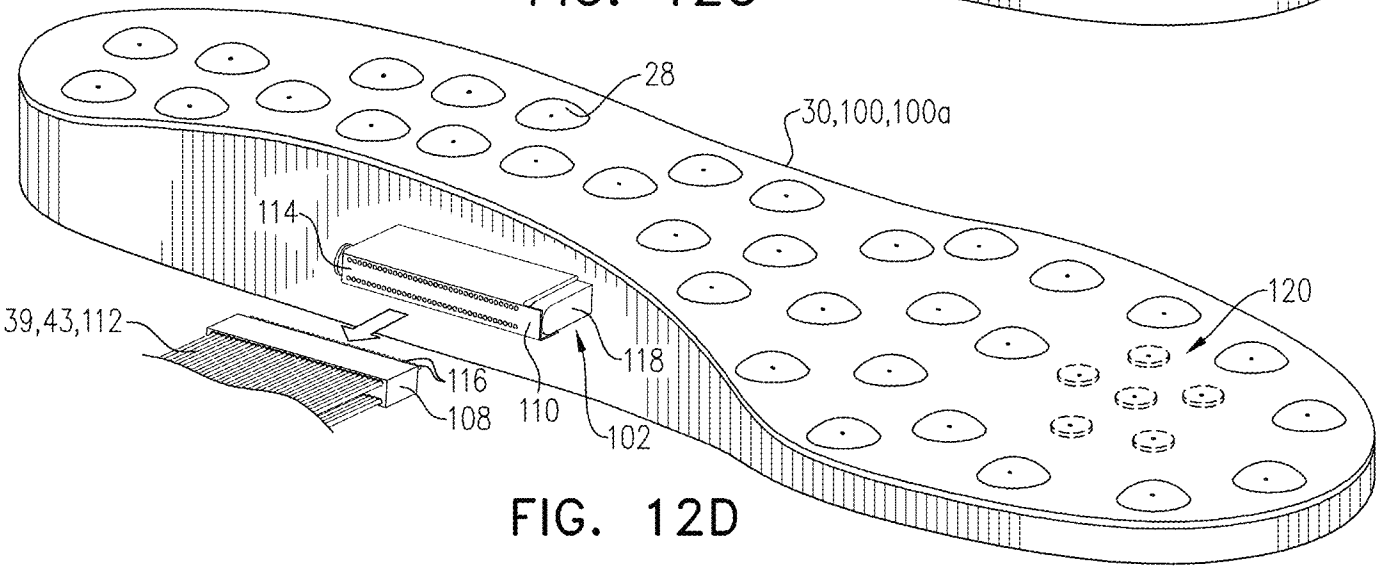

Lock 102 is positioned within lock housing 110 and arranged such that (a) when lock 102 is in an open position (as shown in FIG. 13A) there is fluid communication between inlet 106 of each tube 104 and the respective one of the plurality of chambers 28, and (b) when lock 102 is in a closed position (as shown in FIG. 13B), lock 102 occludes plurality of tubes 104 such that there is no fluid communication between inlet 106 of each tube 104 and the respective one of plurality of chambers 28. For some applications, transitioning lock 102 from the open position to the closed position, and vice versa, may be performed using a lock handle 118. In FIGS. 12A, 12B, and 12D lock handle 118 is shown in a position that corresponds to lock 102 being in the closed position, i.e., occluding tubes 104. In FIG. 12C, lock handle 118 is shown in a position that corresponds to lock 102 being in the open position, i.e., allowing fluid communication between inlet 106 of each tube 104 and the respective one of plurality of chambers 28.

For some applications, an example of a sequence of selectively inflating chambers 28 is represented by FIGS. 12A-D, as follows:

- In FIG. 12A plurality of chambers 28 are uninflated, lock 102 is in the closed position (as indicated by the position of lock handle 118), and pump connector 108 is disconnected from lock housing 110.
- FIG. 12B shows pump connector 108 coupled to lock housing 110 while lock 102 remains in the closed position. FIG. 13B is a cross-section of pump connector 108 and lock housing 110 in the state that is shown in FIG. 12B.
- FIG. 12C shows that lock 102 has been changed to the open position so as to allow fluid communication to plurality of chambers 28. Pump 38 is then actuated to selectively inflate some of chambers 28. In the particular example shown in FIG. 12C, the majority of chambers 28 are inflated except for a small area 120 that may correspond to a location on the user's foot that has a lesion. Inflating chambers 28 in the areas surrounding the lesion provides protection for the lesion and comfort for the user while walking. FIG. 13A is a cross-section of pump connector 108 and lock housing 110 in the state that is shown in FIG. 12C. Arrows 122 in the cross-section shown in FIG. 13A depict the direction of air flow from pump 38 as the chambers 28 are inflated.
- FIG. 12D shows that lock 102 has been changed back to the closed position, thereby occluding tubes 104. Pump connector 108 can then be decoupled from lock housing 110 (depicted in FIG. 14) without affecting the respective pressures in the plurality of chambers 28.

It is noted that FIGS. 12A-D depict an insole body by way of example only. As described hereinabove, and as further described hereinbelow with reference to FIG. 26, user device 100 may be a footwear device 100*a* (e.g., a shoe, an insole body shaped and sized to be placed in a shoe, or a sock), a medical device 100*b* (e.g., a bandage, cast, or wound packing apparatus), a mattress device 100*c* (e.g., a mattress or a mattress cover), or a seat cushion 100*d* (e.g., a chair cushion or a bike seat). The features of lock 102 and pump connector 108 as described hereinabove may be used with any of the above-mentioned user devices.

Reference is now made to FIGS. 15A-D, 16A-B, and 17, which depict user device 100, e.g., footwear device 100*a*, e.g., insole body 30, and a lock 102 for controlling fluid communication to plurality of chambers 28, in accordance with some applications of the present invention. For some applications of the present invention, the mechanisms of inflation described herein are adapted to allow for the controlled deflation of the aforementioned chambers, rather than for the controlled inflation of the chambers. For some applications, such as in the example shown in FIG. 15A, the shape of each chamber 28 is (a) expanded in a state of chamber 28 in which air pressure in chamber 28 is atmospheric pressure and (b) contracted in a state of chamber 28 in which air pressure in chamber 28 is below atmospheric pressure.

Similarly to as described hereinabove with reference to FIGS. 12A-D, user device 100, e.g., footwear device 100*a*, e.g., insole body 30, includes plurality of tubes 104 (shown in FIGS. 16A-B and 17), each tube 104 in fluid communication with a respective one of plurality of chambers 28. Each tube 104 has inlet 106 to which a source of suction is couplable to provide fluid communication between inlet 106 and the source of suction. For some applications, the source of suction may be a pump, e.g., pump 38. When the pump is coupled to user device 100, the pump may apply suction to at least one of plurality of chambers 28.

The features of lock 102, lock housing 110, pump connector 108, and lock handle 118 as described with reference to FIGS. 12A-B, 13A-B, and 14 apply regardless of whether (i) chambers 28 initially start in a contracted state and are inflated or (ii) chambers 28 initially start in an expanded state and are contracted.

Figure 15A:
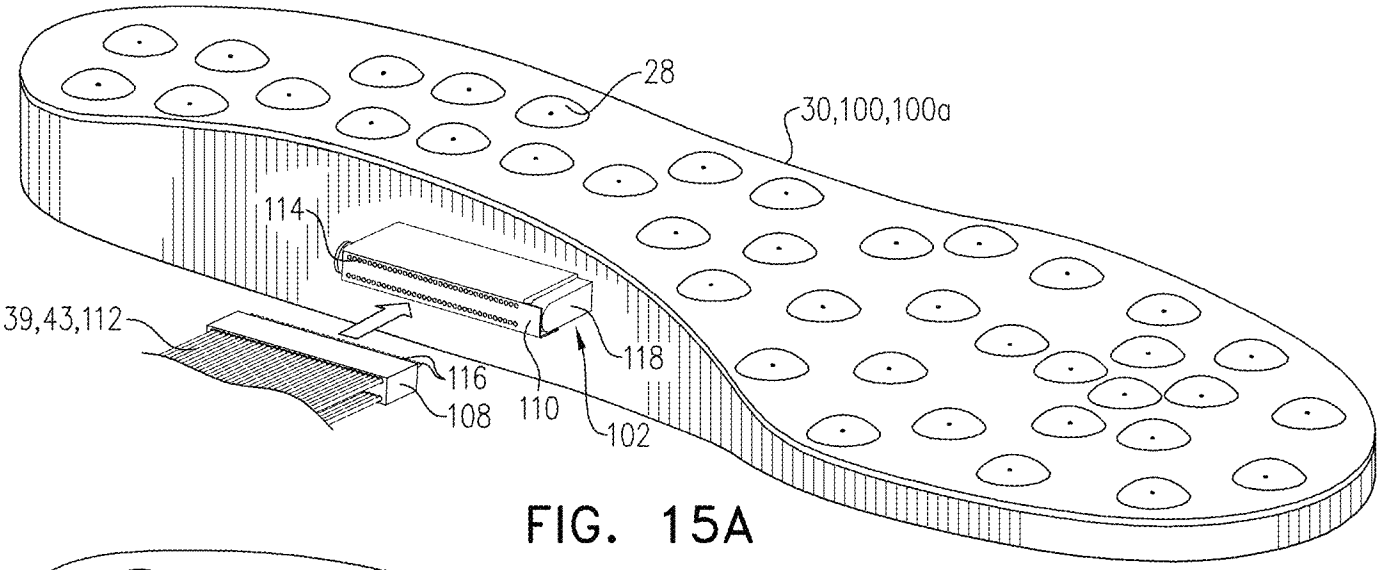
FIGS. 15A-D, 16A-B, and 17 depict a user device and a lock for controlling fluid communication to a plurality of chambers, in accordance with some applications of the present invention.

For some applications, an example of a sequence of selectively applying suction to deflate chambers 28 is represented by FIGS. 15A-D, as follows:

In FIG. 15A, plurality of chambers 28 are in the expanded state, lock 102 is in the closed position (as indicated by the position of lock handle 118), and pump connector 108 is disconnected from lock housing 110.

Figure 15B:
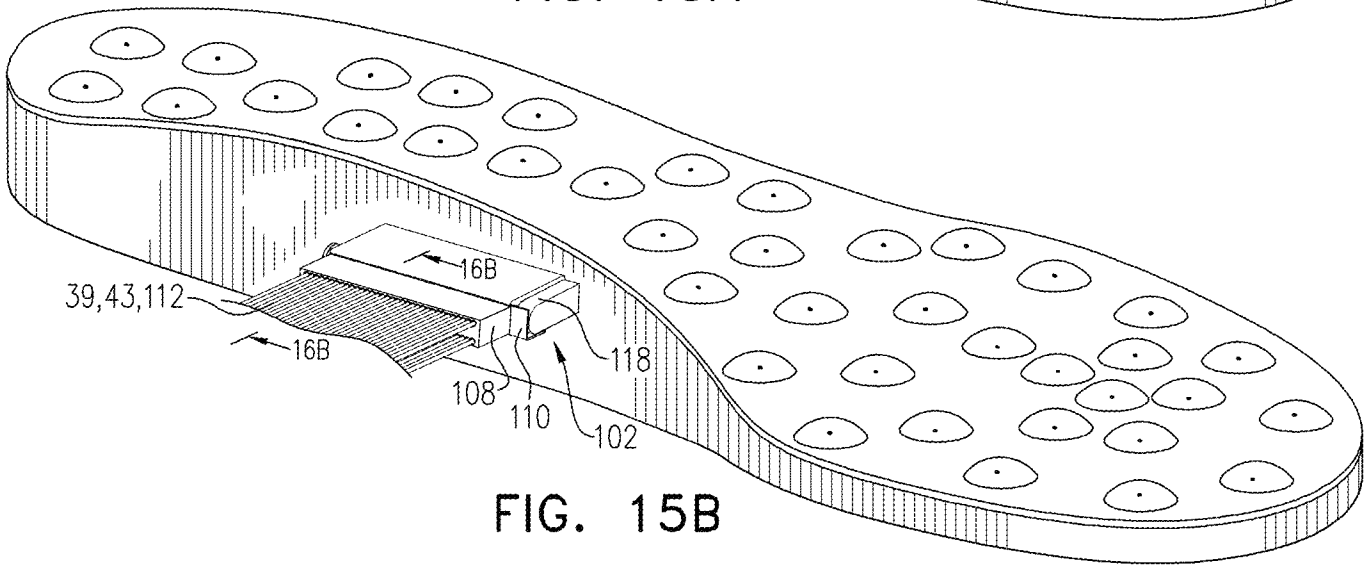
Figure 16A:
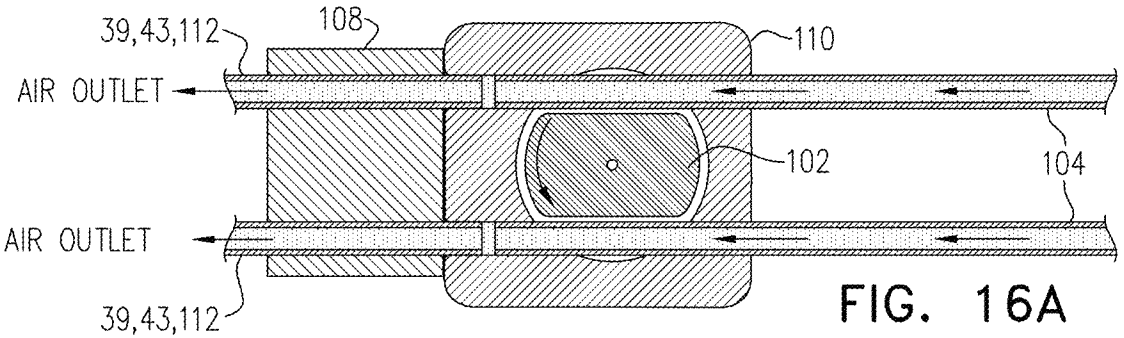
Figure 16B:
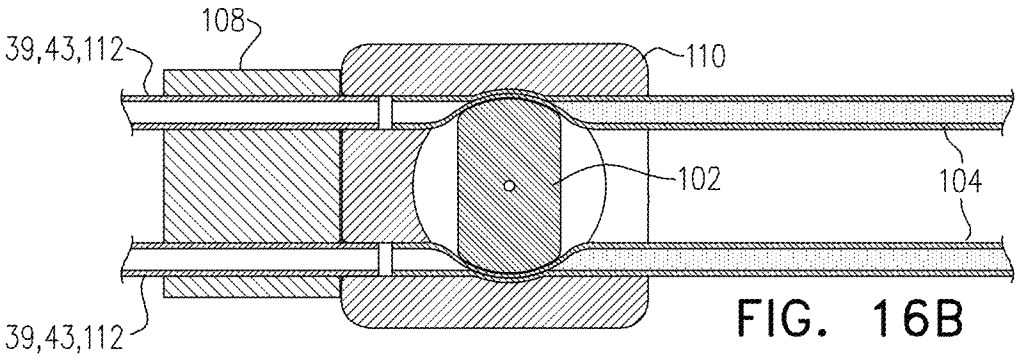
Figure 17:
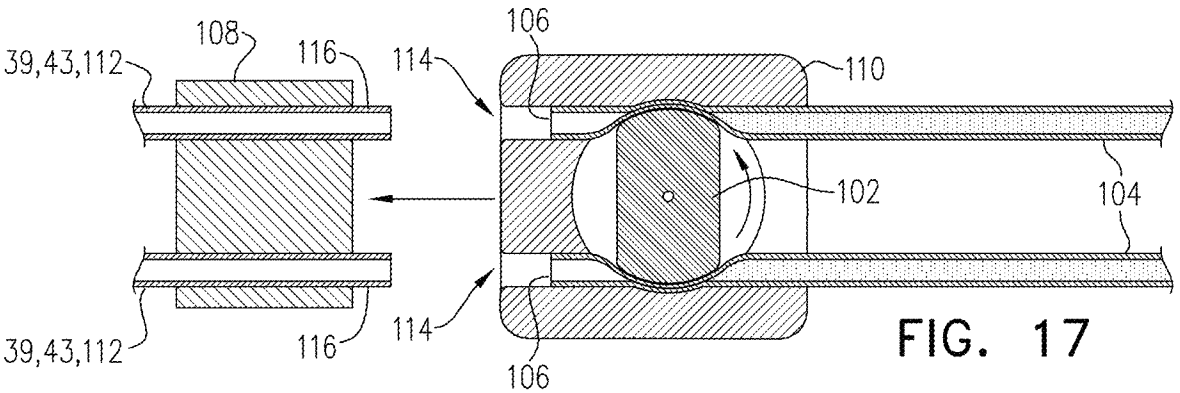
Figure 18A:
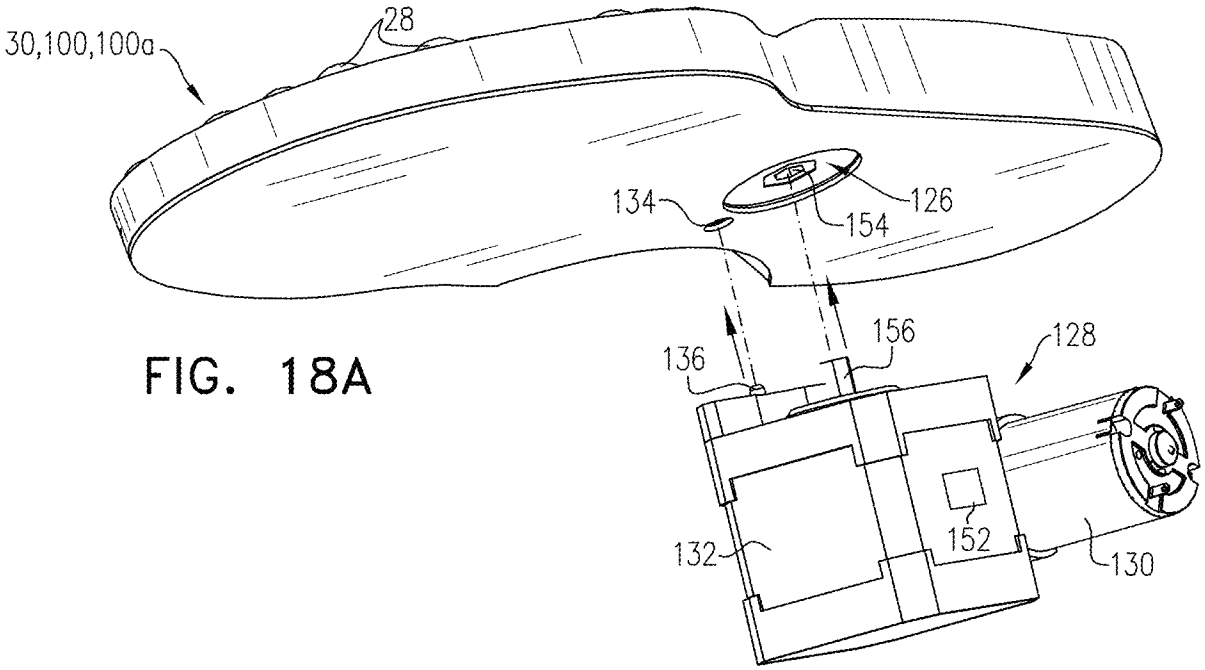
FIGS. 18A-B, 19A-B, and 20 depict a user device with a selector valve integrated into the user device, in accordance with some applications of the present invention.
Figure 18B:
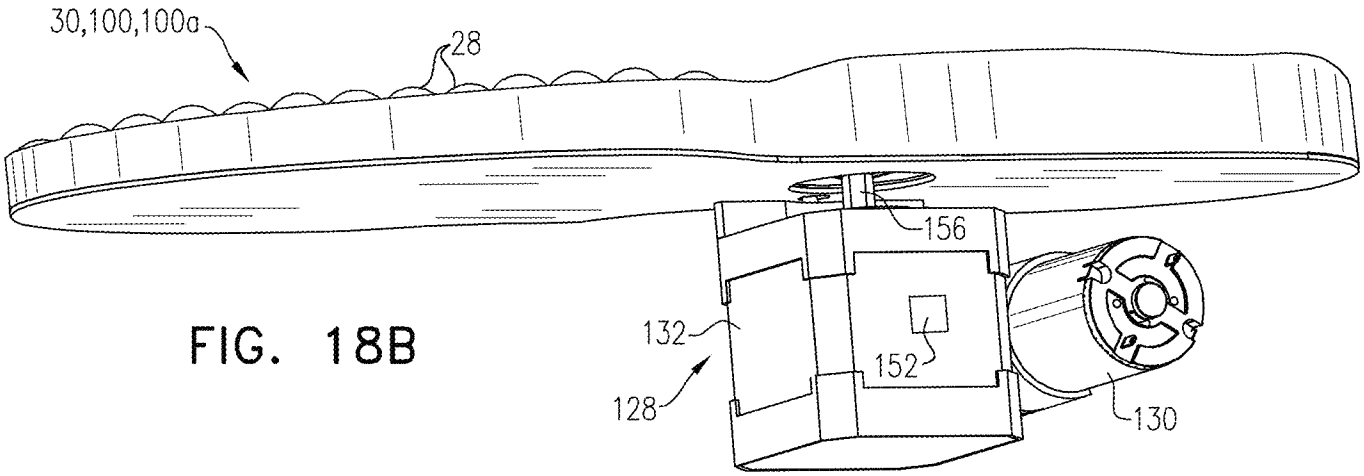

FIG. 15B shows pump connector 108 coupled to lock housing 110 while lock 102 remains in the closed position. FIG. 16B is a cross-section of pump connector 108 and lock housing 110 in the state that is shown in FIG. 15B.

Figure 15C:
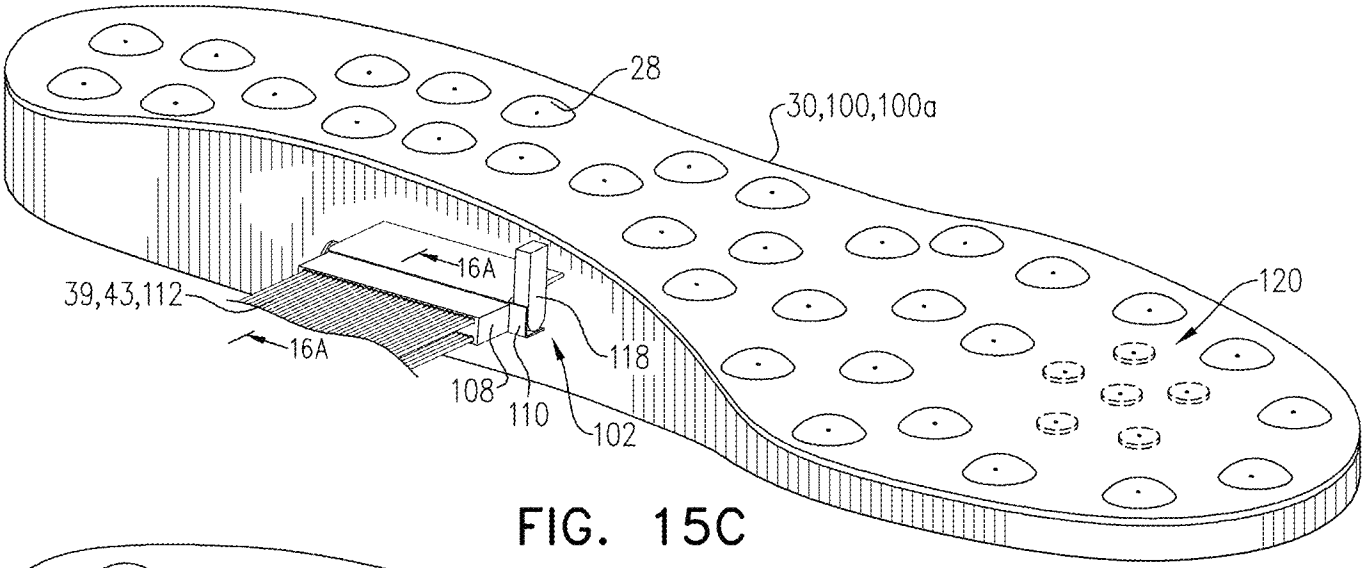

FIG. 15C shows that lock 102 has been changed to the open position so as to allow fluid communication to plurality of chambers 28. Pump 38 is then actuated to apply suction to selectively deflate some of chambers 28. In the particular example shown in FIG. 15C, the majority of chambers 28 remain in their expanded state except for a small area 120 that may correspond to a location on the user's foot that has a lesion. Deflating chambers 28 only in the area corresponding to the lesion provides protection for the lesion and comfort for the user while walking. FIG. 16A is a cross-section of pump connector 108 and lock housing 110 in the state that is shown in FIG. 15C. Arrows 124 in the cross-section shown in FIG. 16A depict the direction of air flow from pump 38 as suction is applied to deflate the chambers 28.

Figure 15D:
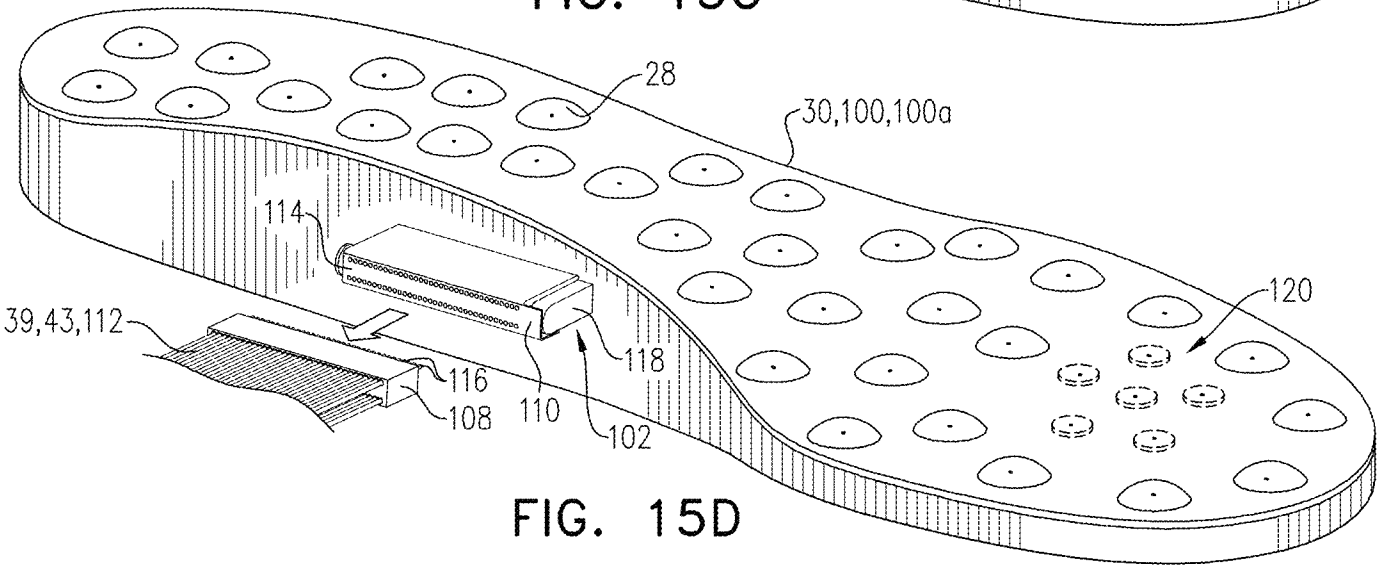

FIG. 15D shows that lock 102 has been changed back to the closed position, thereby occluding tubes 104. Pump connector 108 can then be decoupled from lock housing 110 (depicted in FIG. 14) without affecting the respective pressures in the plurality of chambers 28.

It is noted that FIGS. 15A-D depict an insole body by way of example only. As described hereinabove, and as further described hereinbelow with reference to FIG. 26, user device 100 may be a footwear device 100*a* (e.g., a shoe, an insole body shaped and sized to be placed in a shoe, or a sock), a medical device 100*b* (e.g., a cast or a bandage, for example used to reduce pressure on a lesion), a mattress device 100*c* (e.g., a mattress or a mattress cover, for example used to reduce pressure on a bed sore), or a seat cushion 100*d* (e.g., a chair cushion or a bike seat, for example used to reduce pressure on a lesion).

Reference is now made to FIGS. 18A-B, 19A-B, and 20, which depict user device 100, e.g., footwear device 100*a*, e.g., insole body 30, with a selector valve 126 integrated into user device 100, in accordance with some applications of the present invention. For some applications, alternatively to a selector valve being part of a pumping apparatus that is external to user device 100 (such as shown in FIGS. 3, 4, 5A-B, 6, and 7A-B), selector valve 126 is integrated into user device 100, e.g., disposed at least partially within user device 100, and is arranged to interface with an external pressure apparatus 128 that typically includes a pump 130 and a motor 132. An advantage of integrating the selector valve into user device 100 is that it simplifies the connection between pressure apparatus 128 and user device 100. Instead of connecting a plurality of tubes to a plurality of respective openings in user device 100, (e.g., as depicted hereinabove with respect to pump connector 108) selector valve 126 has a pump port 134 to which pressure apparatus 128 is couplable, e.g., to which pump 130 of pressure apparatus 128 is couplable. Typically, pump 130 has a single output tube 136 which couples to pump port 134.

For some applications, selector valve 126 has two or more interface ports 138 each having a respective inlet 140 and a respective outlet 142. Outlet 142 of a first interface port 138 is in fluid communication with a first one of chambers 28, e.g., via a tube 144 (FIG. 19A), and outlet 142 of a second interface port 138 is in fluid communication with a second one of chambers 28. Typically, selector valve 126 has an interface port 138 corresponding to each one of chambers 28 in user device 100. Inlets 140 of each interface port 138 are in fluid communication with pump port 134. For some applications, and as shown, all of inlets 140 are open to a common space 146 which is in fluid communication with pump port 134.

A pressing surface 148 is arranged within selector valve 126 such that (a) in a first position of pressing surface 148, pressing surface 148 provides fluid communication between pump port 134 and inlet 140 of the first one of interface ports 138 and restricts fluid communication between pump port 134 and outlet 142 of the second one of interface ports 138, and, at a different time, (b) in a second position of pressing surface 148, pressing surface 148 provides fluid communication between pump port 134 and outlet 142 of the second one of interface ports 138 and restricts fluid communication between pump port 134 and inlet 140 of the first one of interface ports 138. Typically, in each position of pressing surface 148, pressing surface 148 restricts fluid communication between pump port 134 and all but one of outlets 142 of interface ports 138, such that the fluid communication between pump port 134 and each chamber 28 may be actuated in a one-at-a-time manner.

Furthermore, there is typically provided a "blank" position in which pressing surface 148 may be positioned such that pressing surface 148 restricts fluid communication between pump port 134 and all of outlets 142 of interface ports 138. That is, when pressing surface 148 is placed in the "blank" position, fluid access to all of plurality of chambers 28 is blocked, thereby enabling pressure apparatus 128 to be decoupled from user device 100 without the decoupling affecting the respective pressures within plurality of chambers 28.

Figure 20:
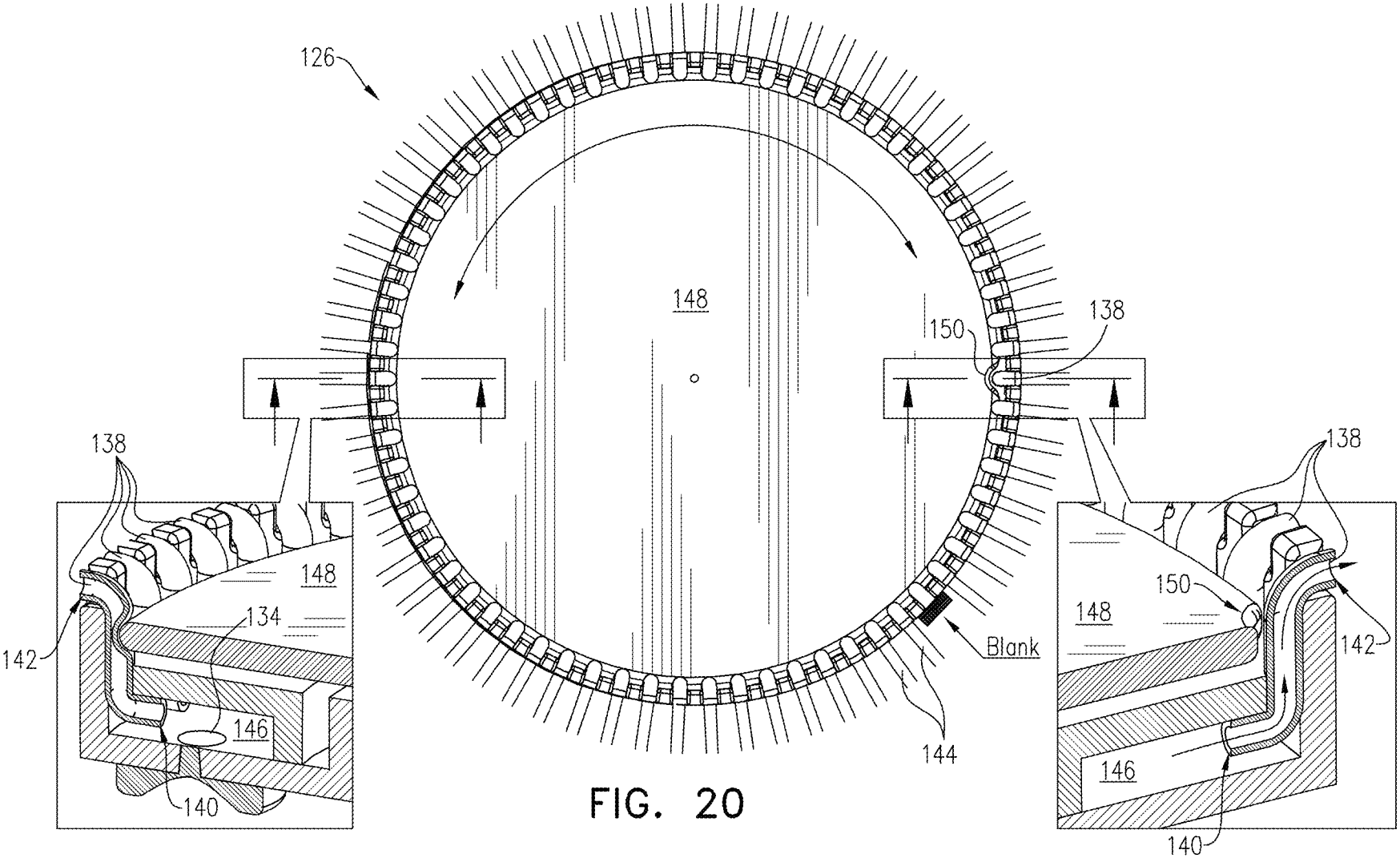

By way of example, FIG. 20 shows pressing surface 148 arranged so as to occlude interface ports 138 at a location between inlet 140 and outlet 142, thereby restricting fluid communication to chamber 28. The enlarged view on the left side of FIG. 20 shows pressing surface 148 occluding interface ports 138. At one location on pressing surface 148 there is a recess 150. In each respective position of pressing surface 148, recess 150 lines up with a given interface port 138 or with the "blank" position. When recess 150 is lined up with a given interface port 138, that interface port 138 is not occluded by pressing surface 148 such that there is fluid communication between pump port 134 and outlet 142 of that interface port 138. The enlarged view on the right side of FIG. 20 shows recess 150 enabling fluid communication between pump port 134 and outlet 142 of a given interface port 138.

Figure 19A:
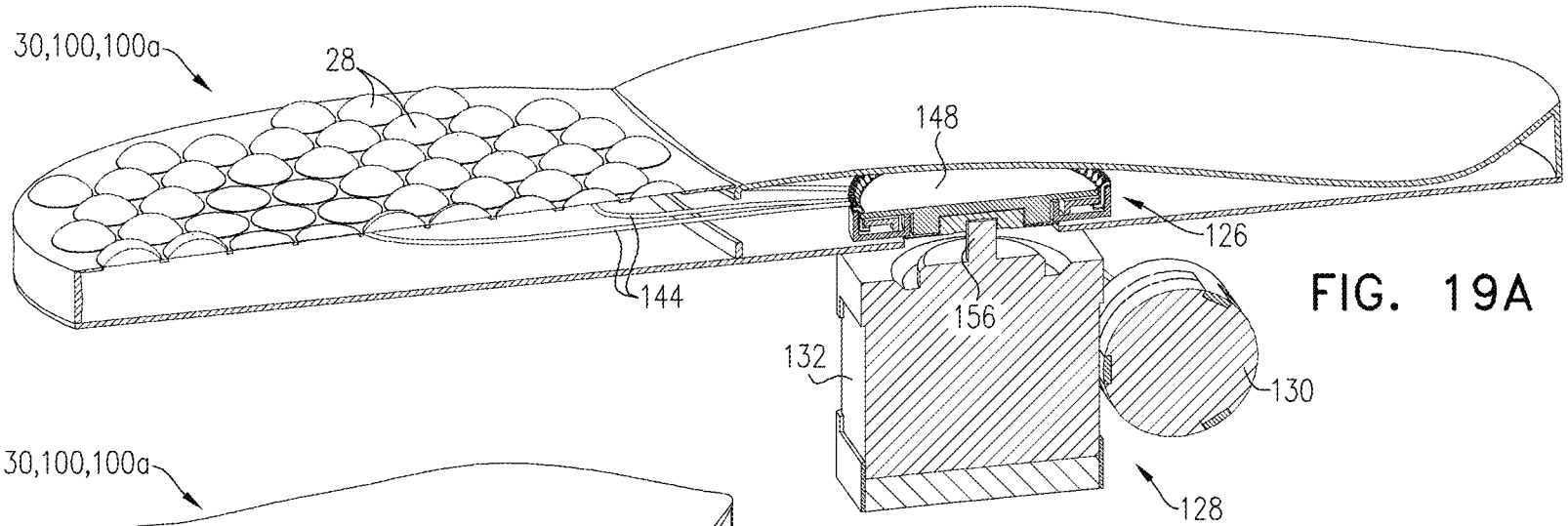
Figure 19B:
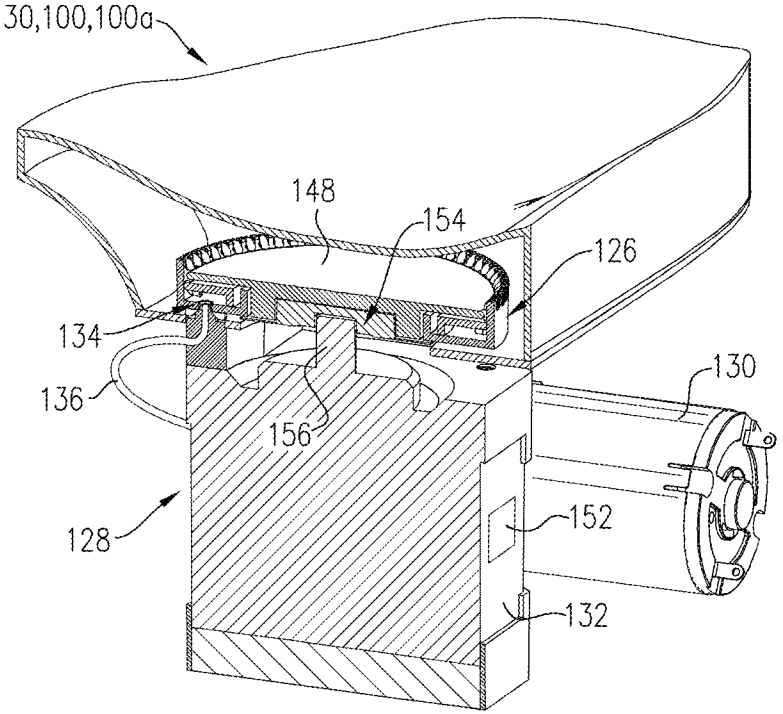

For some applications, such as is shown by way of example in FIGS. 19A-B and 20, pressing surface 148 is a rotary pressing surface 148 and interface ports 138 are positioned in a circular manner around the edge of pressing surface 148. In this example, the positions of pressing surface 148 described hereinabove refer to rotational positions of pressing surface 148.

For some applications, pressure apparatus 128 includes pump 130 couplable to pump port 134, motor 132 which may be actuated to change the position of pressing surface 148, and control circuitry 152. For some applications, selector valve 126 has a motor port 154 to which motor 132 is couplable, e.g., via a motor-protrusion 156. When pump 130 is coupled to pump port 134, control circuity 152 may actuate pump 130 to inflate or deflate the first and second chambers 28, e.g., selectively inflate or deflate any of chambers 28 of user device 100, by:

(i) actuating motor 132 to position pressing surface 148 in the first position and while pressing surface 148 is in the first position actuating pump 130 to apply either positive or negative pressure to inflate or deflate the first one of chambers 28 to a first pressure, and subsequently (ii) actuating motor 132 to position pressing surface 148 in the second position and while pressing surface 148 is in the second position actuating pump 130 to apply either positive or negative pressure to inflate or deflate the second one of chambers 28 to a second pressure.

In this manner, pressing surface 148 may be moved sequentially through the various positions corresponding to each interface port 138 so as to selectively inflate, deflate, or skip, each chamber 28 (according to a user's particular needs) until pressing surface 148 reaches the "blank" position, at which point pressure apparatus 128 can be decoupled from user device 100 without the decoupling affecting the respective pressures within plurality of chambers 28.

For some applications, pressure apparatus 128 may be packaged for commercial sale separately from user device 100. Alternatively, for some applications, user device 100 is sold commercially together with pressure apparatus 128 as a system.

Reference is now made to FIGS. 21A-B, 22, 23, 24A-C, and 25A-C, which depict a process for manufacturing user device 100, e.g., footwear device 100*a*, e.g., insole body 30, in accordance with some applications of the present invention. For some applications, user device 100 is manufactured such that one integral piece of elastomer 158 is shaped to define plurality of selectively inflatable or deflatable chambers 28. Each chamber 28 is shaped to define an orifice 160 such that integral piece of elastomer 158 forms (i) orifice 160, (ii) an orifice-end wall 162 of each chamber 28, and (iii) a flexible wall 164, e.g., an expandable wall, opposite the orifice-end wall of each chamber 28. For some applications, an advantage of forming chambers 28 out of one integral piece of elastomer is that as flexible wall 164 moves (e.g., stretches) during inflation or deflation of chambers 28, the integral piece of elastomer pulls against itself rather than, for example, against a seam.

Typically, a plurality of plugs 166 are disposed, respectively, in orifices 160 of plurality of chambers 28. Each plug 166 includes a respective tube 144 such that each tube 144 is in fluid communication with a respective chamber 28 (e.g., tubes 144 as shown in FIG. 19A). Each tube 144 has an inlet 168 to which a source of positive or negative pressure, e.g., a pump, is couplable to selectively inflate or deflate chambers 28 to at least two different respective pressures.

For some applications, each plug 166 has a plug-head 170 that is disposed against an interior surface 172 of orifice-end wall 162 of each respective chamber 28, such that when a given chamber 28 is inflated or deflated, movement of orifice-end wall 162 toward flexible wall 164 that is opposite orifice-end wall 162 is inhibited by plug-head 170. For some applications, the gaps between each plug 166 and orifice 160 of chamber 28 are created by placing a sealing substance 174 that hardens into orifice 160 after plug 166 is disposed in orifice 160. As shown in FIGS. 24B and 25B, sealing substance 174 surrounds tube 144 of each plug 166.

For some applications, in order to further inhibit movement of orifice-end wall 162 during inflation or deflation of chamber 28, a respective support 176 is disposed against an exterior surface 178 of orifice-end wall 162 of each chamber 28, surrounding orifice 160. When a given chamber is inflated or deflated, movement of orifice-end wall 162 away from flexible wall 164 that is opposite orifice-end wall 162 is inhibited by support 176. For some applications, in order to secure support 176 in place, more sealing substance 174 is placed between orifice 160 and support 176 on exterior surface 178 of orifice-end wall 162.

Alternatively or additionally, for some applications, orifice-end wall 162 is thicker than flexible wall 164, such that when a given chamber is inflated or deflated the thickness of orifice-end wall 162 inhibits movement of orifice-end wall 162 of chamber 28.

Figure 24A:
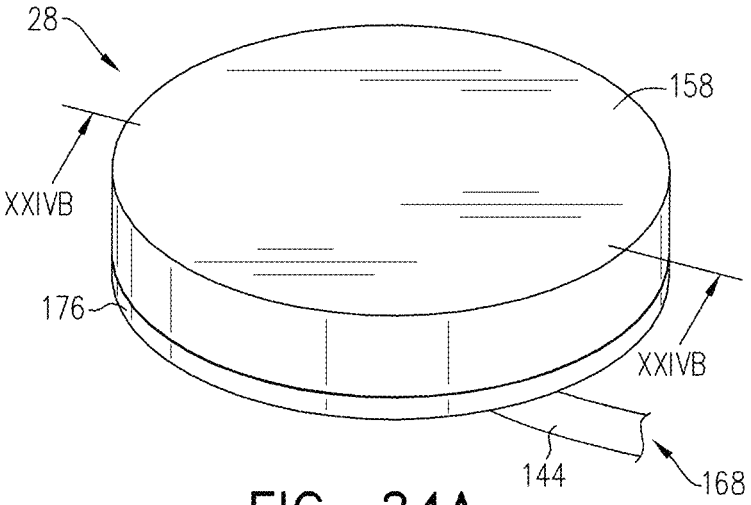
Figure 24B:
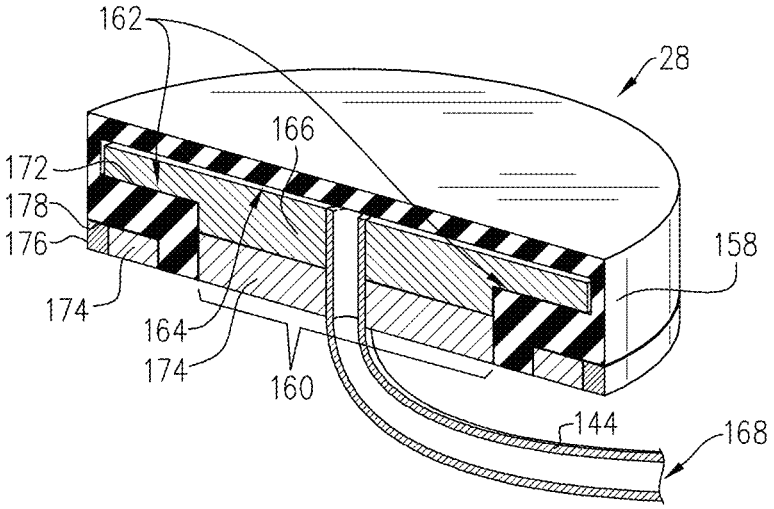

FIGS. 24A-B depict by way of example a single chamber 28 of user device 100 in a contracted state of chamber 28. As described hereinabove, one integral piece of elastomer 158 forms orifice 160 as well as orifice-end wall 162 and flexible wall 164 of chamber 28. Plug 166 is shown disposed within chamber 28, support 176 is shown supporting exterior surface 178 of orifice-end wall 162, and sealing substance 174 can be seen sealing the gaps between plug 166 and orifice 160, as well as holding support 176 in place.

Figure 25A:
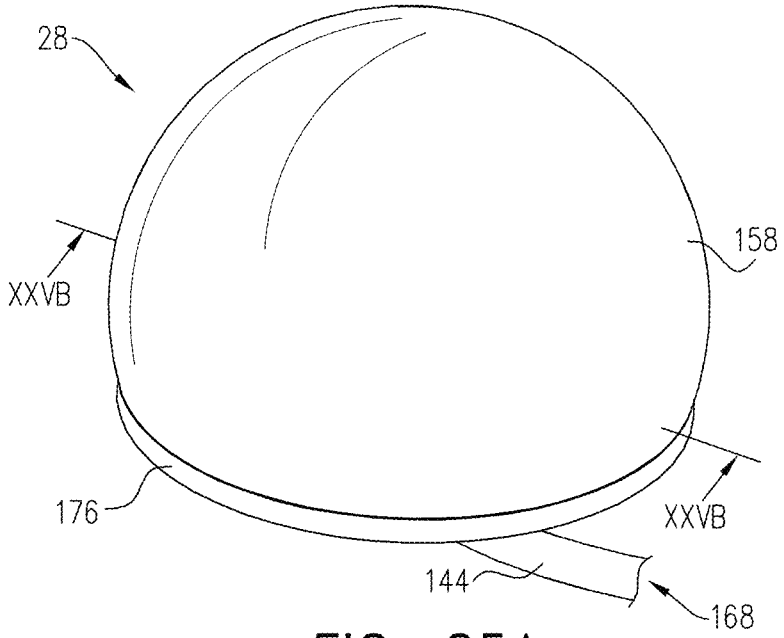
Figure 25B:
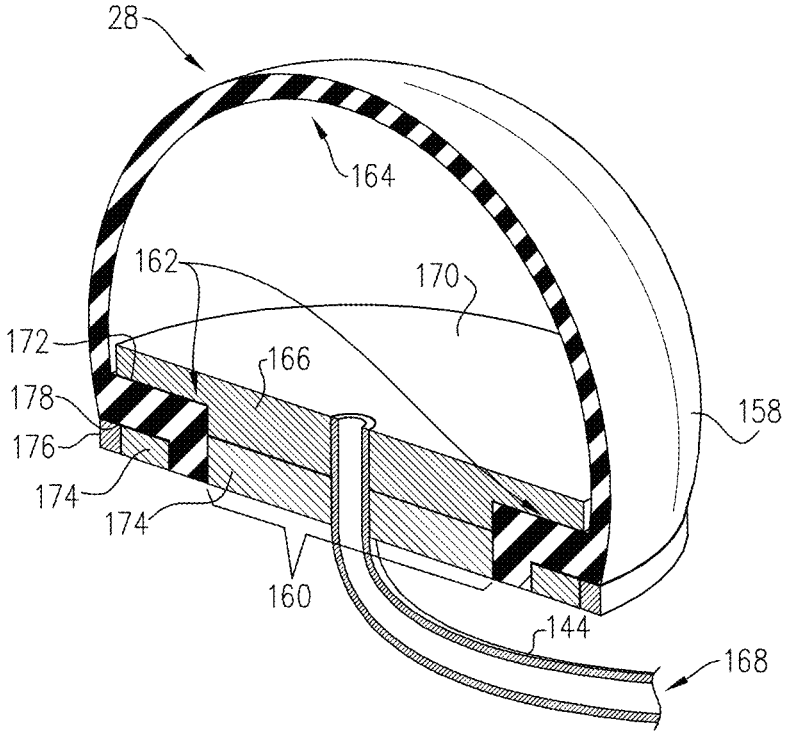

FIGS. 25A-B depict, by way of example, a single chamber 28 of user device 100 in an expanded, e.g., inflated, state of chamber 28.

Reference is made to FIGS. 21-25. For some applications, a method of manufacturing user device 100, e.g., footwear device 100*a*, e.g., insole body 30, is as follows:

A first plate 180 is placed in proximity to a second plate 182, first plate 180 shaped to define a plurality of holes 184. A plurality of removable inserts 186 are disposed respectively within each hole 184. Each insert 186 is shaped to have a head 188 that is disposed on a top-side 190 of first plate 180 when inserts 186 are disposed within holes 184.

Figure 21A:
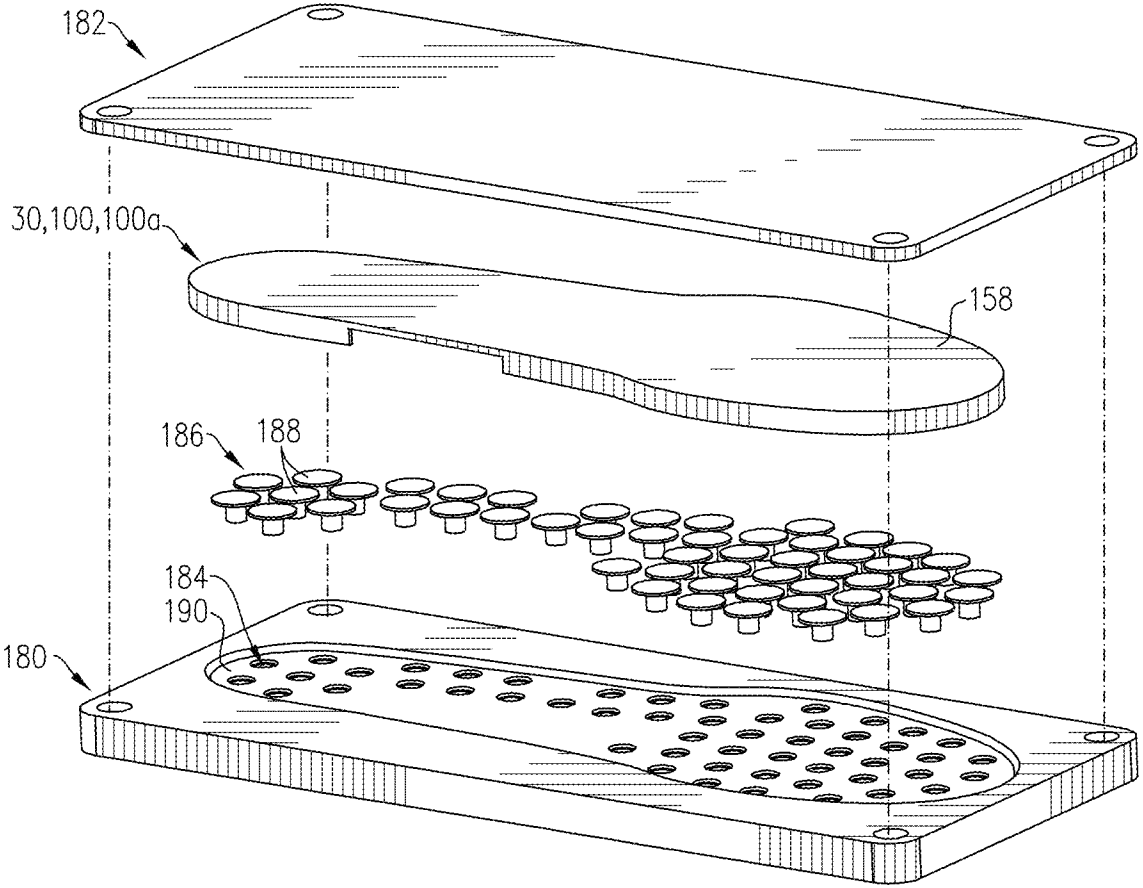
FIGS. 21A-B, 22, 23, 24A-C, and 25A-B depict a process for manufacturing a user device, in accordance with some applications of the present invention.

A liquid elastomer 158 is injected between first plate 180 and second plate 182 such that liquid elastomer 158 surrounds head 188 of each removable insert 186, and such that liquid elastomer 158 is enclosed between first plate 180 and second plate 182 as elastomer 158 solidifies. FIG. 21A shows an exploded view of inserts 186 corresponding to holes 184 in which they are disposed and elastomer 158 which is enclosed between the first and second plates.

Once elastomer 158 has solidified, second plate 182 is removed from first plate 180. The solidified elastomer is then removed from first plate 180, whereby the removing of the solidified elastomer pulls removable inserts 186 out of respective holes 184 in first plate 180.

Figure 21B:
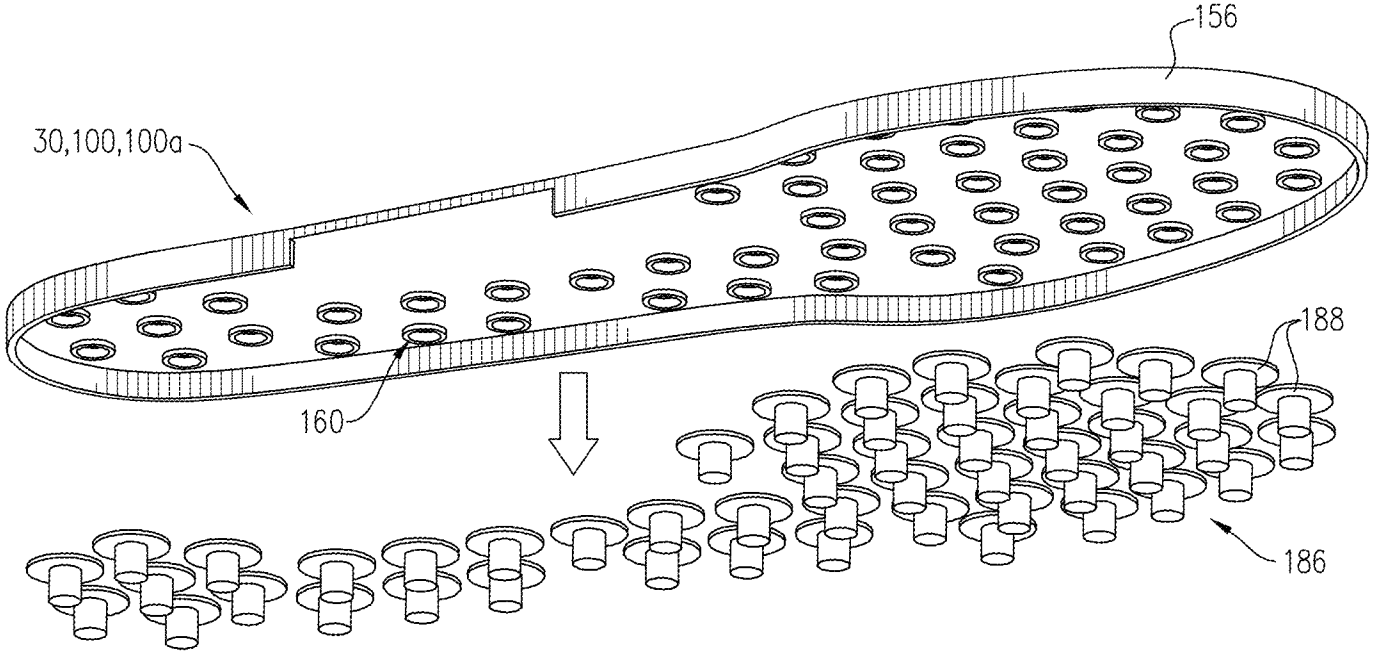

Removable inserts 186 are then removed from solidified elastomer 158 such that a respective chamber 28 is defined in the solidified elastomer where the elastomer had surrounded each of heads 188. Each chamber 28 is shaped to define (i) orifice 160, (ii) orifice-end wall 162, and (iii) flexible wall 164 opposite orifice-end wall 162. FIG. 21B depicts the removal of inserts 186 from respective chambers 28 after solidified elastomer 158 has been removed from first plate 180.

Figure 23:
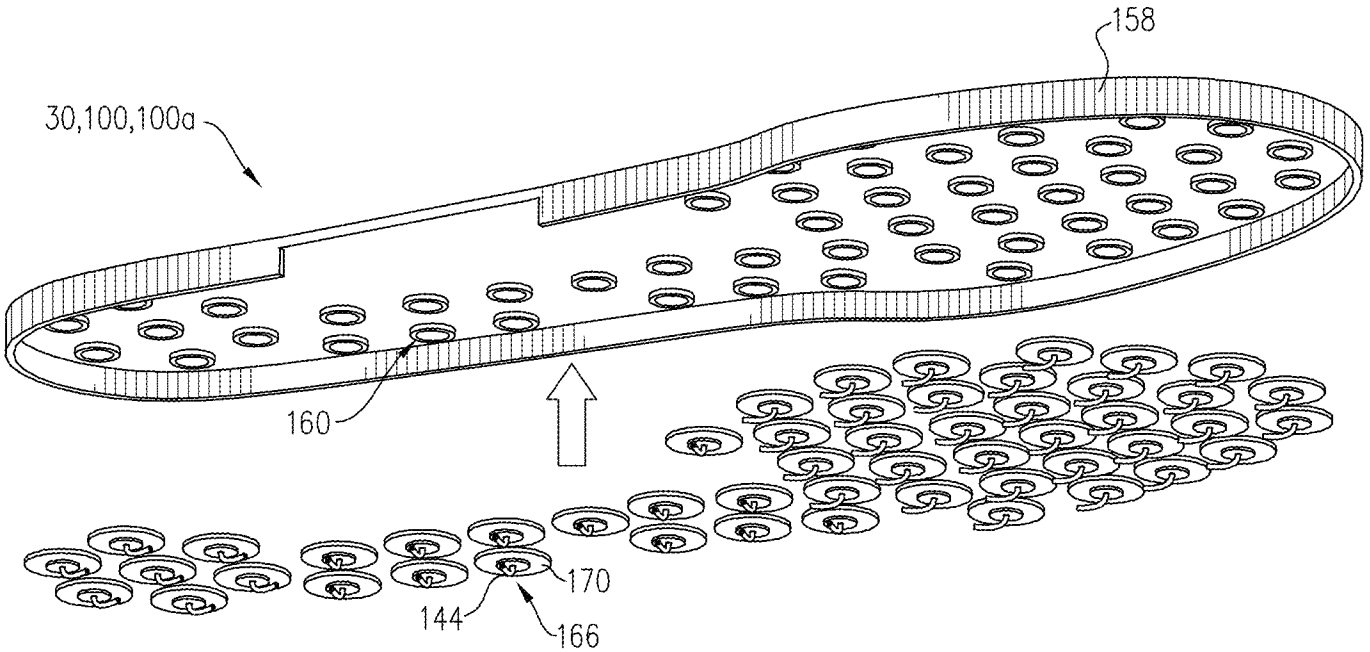

Plugs 166 are then inserted into each of chambers 28 as described hereinabove. FIG. 23 depicts the insertion of plugs 166 into respective chambers 28.

Figure 24C:
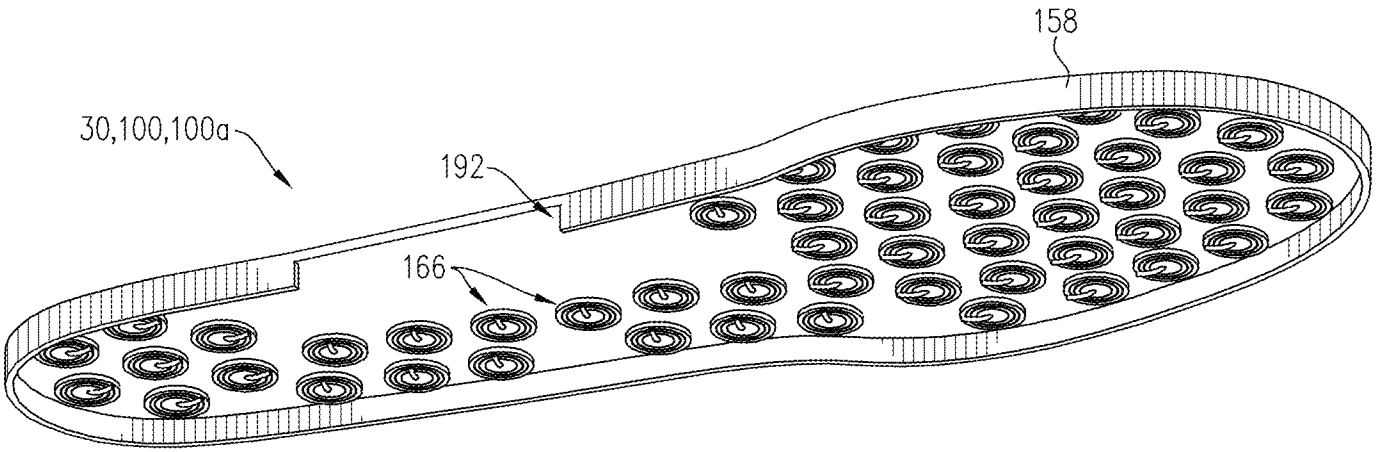

As described hereinabove, the gaps between each plug 166 and orifice 160 are sealed and, optionally, support 176 is attached. FIG. 24C shows an example of a user device 100, e.g., footwear device 100*a*, e.g., insole body 30, with plugs 166 disposed in each chamber 28, and supports 176 disposed around each orifice 160. It is noted that, as shown in FIG. 24C, plugs 166 are placed into chambers 28 such that each tube 144 points in the general direction of a side-gap 192 in solidified elastomer 158. This allows tubes 144 to be gathered together in a common direction. For example, as described hereinabove, all of tubes 144 may be coupled to a common selector valve or lock housing.

Figure 22:
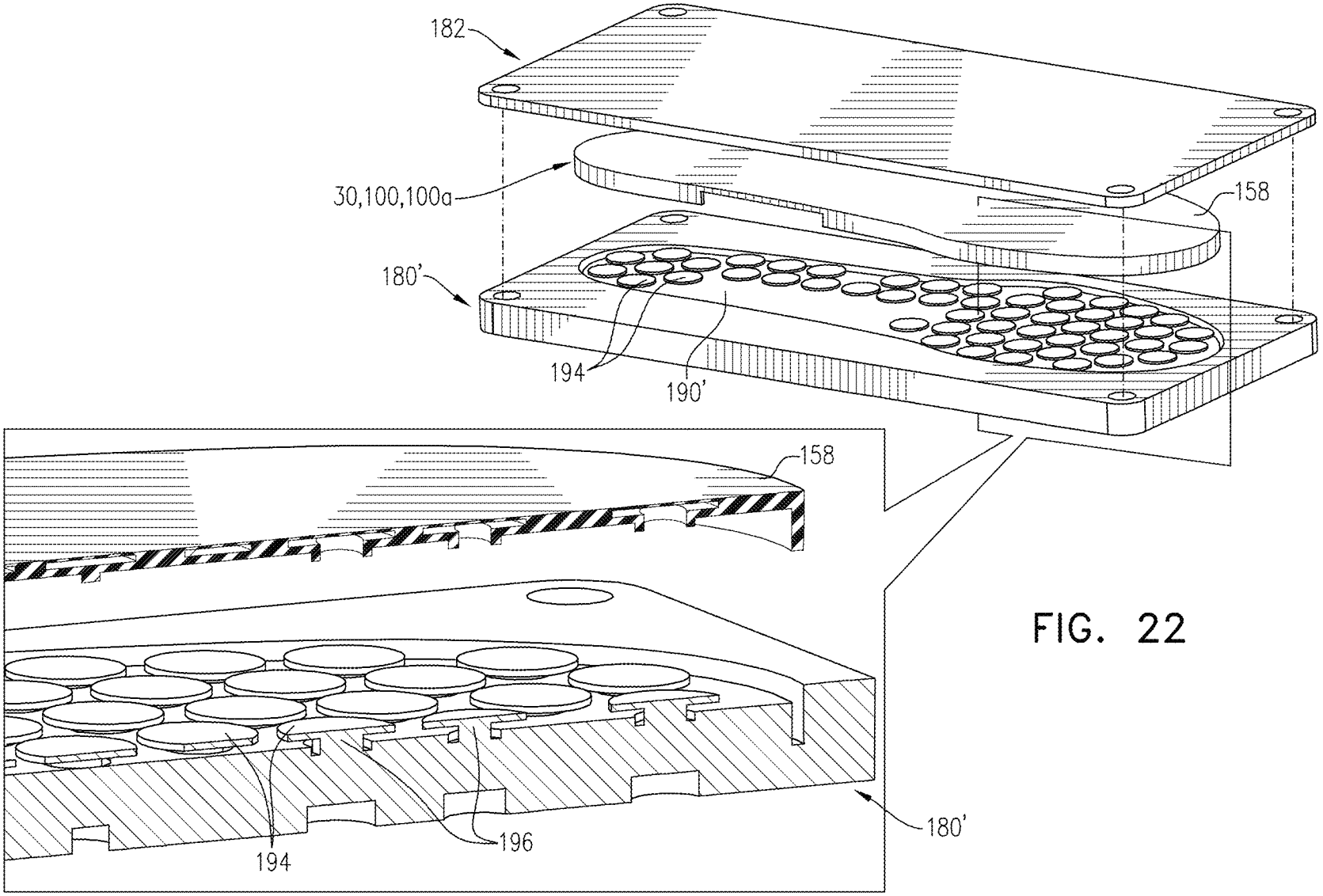

For some applications, an alternative method of manufacturing user device 100 is shown in FIG. 22. For some applications, rather than using removable inserts 186, first plate 180' is shaped to define a plurality of heads 194 that are each disposed on a respective post 196 protruding from a top-side 190' of first plate 180'. Liquid elastomer 158 is injected between first plate 180' and second plate 182 such that the liquid elastomer surrounds each head 194 and each post 196, and such that the liquid elastomer is enclosed between the first and second plates. Once elastomer 158 has solidified, second plate 182 is removed from first plate 180' and then solidified elastomer 158 is removed from first plate 180' such that a respective chamber 28 is defined in the solidified elastomer where the elastomer had surrounded each of heads 194.

Figure 26:
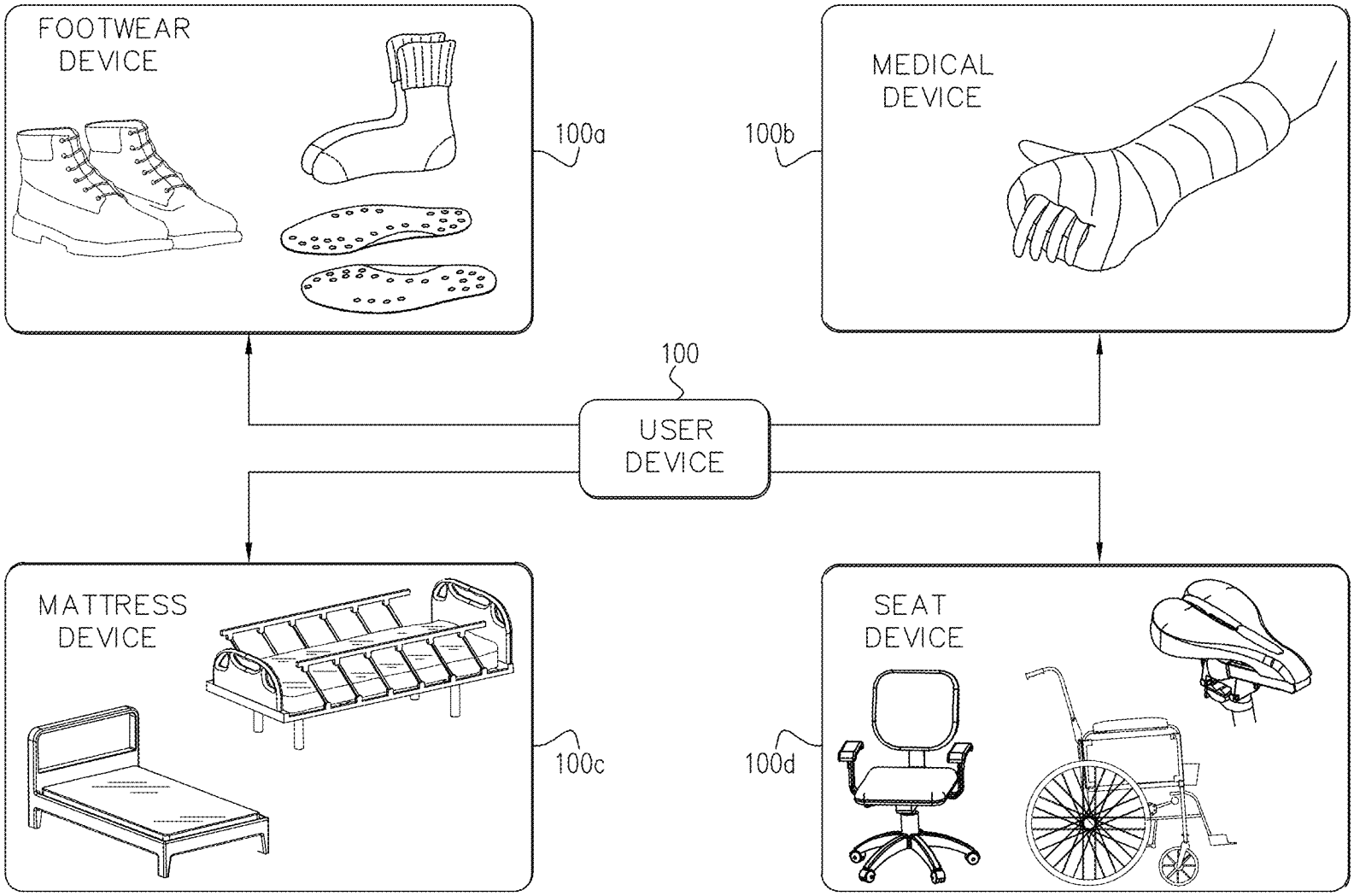
FIG. 26 depicts various examples of a user device, in accordance with some applications of the present invention.

Reference is now made to FIG. 26, which depicts various examples of user device 100. As described hereinabove, although features of the present application are described with reference to an insole body, this is by way of example only and is not intended to be limiting. User device 100 may be a footwear device 100*a*, a medical device 100*b*, a mattress device 100*c*, or a seat cushion 100*d*. Some non-limiting examples in each of the abovementioned categories are as follows:

Footwear Device 100*a*

As described hereinabove, examples of footwear device 100*a* are a shoe, an insole body shaped and sized to be placed in a shoe, and a sock. Footwear device 100*a* may be used for:

medical purposes, e.g., to protect a lesion on a user's foot therapeutic purposes, e.g., to help improve a user's posture, athletic purposes, e.g., to improve fit in order to reduce friction blisters, to enhance comfort, or to enhance support, recreational purposes, e.g., to improve comfort of a user's shoe.

Medical Device 100*b*

As described hereinabove, examples of medical device 100*b* are a bandage, cast, or wound packing apparatus. Medical device 100*b* may be used, for example, to increase or decrease pressure on certain areas in order to stop bleeding, to increase support, or to prevent movement which may be detrimental to a healing process.

Mattress Device 100*c*

As described hereinabove, examples of mattress device 100*c* are a mattress itself or a mattress cover. Use of mattress device 100*c* may be medical, e.g., to help maintain a patient in a certain position, to prevent, protect, and/or treat bed sores. Use of mattress device 100*c* may be therapeutic, e.g., to help improve a user's posture. Use of mattress device 100*c* may also be recreational, e.g., to improve comfort of a user's bed.

Seat Cushion 100*d*

As described hereinabove, examples of seat cushion 100*d* are a chair cushion or a bike seat. Similarly to mattress device 100*c*, use of seat cushion 100*d* may be medical, therapeutic, or recreational.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

The invention claimed is:

1. Apparatus for use with a footwear device shaped to define a plurality of chambers and including one or more valves that control flow to the plurality of chambers, the apparatus comprising:

circuitry, comprising at least one device pressure sensor that is configured to measure pressure in the plurality of chambers; and a pump that is:

(a) couplable to the footwear device by a user, the circuitry configured to actuate the pump when the pump is coupled to the footwear device and while the user walks to selectively inflate or deflate the plurality of chambers to at least two different respective pressures, and (b) decouplable by the user from the footwear device such that the one or more valves remain closed, such that the decoupling does not affect the respective pressures in the plurality of chambers of the footwear device.

2. The apparatus according to claim 1, wherein the footwear device comprises an insole body defining the plurality of chambers and shaped and sized to be placed in a shoe of the user, and wherein the apparatus further comprises a control unit and a coupling mechanism configured to attach the control unit to the shoe, the pump disposed within the control unit such that the pump is:

(a) couplable to the shoe and to the insole body by the user such that the pump is wearable by the user while the user walks, the circuitry configured to actuate the pump when the pump is coupled to the shoe and to the insole body and while the user walks to selectively inflate or deflate the plurality of chambers to at least two different respective pressures, and (b) decouplable by the user from the shoe and from the insole body such that the one or more valves remain closed, such that the decoupling does not affect the respective pressures in the plurality of chambers of the insole body.

3. A system comprising the apparatus of claim 2, the system further comprising the insole body.

4. The system according to claim 3, wherein the circuitry is configured to actuate the pump when the pump is coupled to the insole body to selectively inflate the plurality of chambers to at least two different respective pressures.

5. The apparatus according to claim 1, wherein the footwear device comprises a shoe, and wherein the apparatus further comprises a control unit and a coupling mechanism configured to attach the control unit to the shoe, the pump disposed within the control unit such that the pump is:

(a) couplable to the shoe by the user such that the pump is wearable by the user while the user walks, the circuitry configured to actuate the pump when the pump is coupled to the shoe and while the user walks to selectively inflate or deflate the plurality of chambers to at least two different respective pressures, and (b) decouplable by the user from the shoe such that the one or more valves remain closed, such that the decoupling does not affect the respective pressures in the plurality of chambers.

6. A system comprising the apparatus of claim 5, the system further comprising the shoe.

7. The apparatus according to claim 1, wherein the footwear device includes a respective plurality of valves, each valve in fluid communication with a respective one of the plurality of chambers, and wherein the pump is decouplable by the user from the footwear device such that the respective plurality of valves remain closed.

* * * * *